US006064364A

United States Patent [19]

Katoh et al.

[11] Patent Number: 6,064,364

[45] Date of Patent: May 16, 2000

[54] IMAGE DISPLAY SCANNING CIRCUIT WITH OUTPUTS FROM SEQUENTIALLY SWITCHED PULSE SIGNALS

[75] Inventors: Kenichi Katoh, Tenri; Yasushi Kubota, Sakurai; Hiroshi Yoneda, Ikoma; Tamotsu Sakai, Tenri, all of Japan

[73] Assignee: Sharp Kabushiki Kaisha, Osaka, Japan

[21] Appl. No.: 08/954,177

[22] Filed: Oct. 20, 1997

Related U.S. Application Data

[62] Division of application No. 08/363,217, Dec. 23, 1994, Pat. No. 5,712,653.

[30] Foreign Application Priority Data

| | | | |
|---|---|---|---|
| Dec. 27, 1993 | [JP] | Japan | 5-331624 |
| Dec. 27, 1993 | [JP] | Japan | 5-331625 |
| Dec. 16, 1994 | [JP] | Japan | 6-313815 |

[51] Int. Cl.[7] ..... G09G 3/36

[52] U.S. Cl. ..... 345/100

[58] Field of Search ..... 345/27, 92, 94, 345/100, 165, 168, 30, 55, 84, 87, 98; 326/95, 104, 105; 365/154; 341/109, 55

[56] References Cited

U.S. PATENT DOCUMENTS

| | | | |
|---|---|---|---|
| 4,250,370 | 2/1981 | Sasaki et al. | 219/719 |
| 4,270,125 | 5/1981 | Weisbecker | 345/27 |

(List continued on next page.)

FOREIGN PATENT DOCUMENTS

| | | | |
|---|---|---|---|
| 2-13316 | 4/1990 | Japan | G09G 3/36 |
| 4-46386 | 2/1992 | Japan . | |
| 5-22917 | 3/1993 | Japan | G09G 3/36 |
| 5-108034 | 4/1993 | Japan . | |
| 5-70157 | 10/1993 | Japan | G09G 3/36 |
| 5-289632 | 11/1993 | Japan . | |

OTHER PUBLICATIONS

"3.3–inch, 1.9MPixel Integrated Driver Poly–Si TFT–LCD for HDTV Projector" Nakamura et al, the Proceedings of 1994 IEEE International Solid–State Circuits Conference, pp. 154, 155 and 328.

Harrison M. Wadsworth, Jr., Handbook of Statistical Methods for Engineers & Scientists, 1990, pp. 2.4–2.5.

Katoh, "Matrix Display Apparatus Employing Dual Switching Means and Data Signal Line Driving Means", file May 5, 1994, Appln. S/N 08/238517.

Katoh, "Matrix Type Display Apparatus and a Method for Driving the Same", filed May 27, 1994, Appln. S/N 08/250, 493.

Yoneda et al, "Image Display Apparatus", filed Jun. 22, 1994, Appln. S/N 08/263,742.

U.S. application No. 08/238,517, filed May 5, 1994, U.S. Patent No. 5,777,591.

U.S. application No. 08/250,493, filed May 27, 1994, U.S. Patent No. 5,708,454.

U.S. application No. 08,263,742, filed Jun. 6, 1994, U.S. Patent No. 5,581,273.

*Primary Examiner*—Matthew Luu
*Assistant Examiner*—Jeff Piziali
*Attorney, Agent, or Firm*—Nixon & Vanderhye, P.C.

[57] ABSTRACT

An active-matrix image display device which includes n shift registers, analog switches for sampling video input signals and a data-signal-line driving circuit to which n series of clock signals and n×m series of video input signals are input, and controls the analog switches according to the result of a logic operation of output pulses from successive l stages in the shift registers. A scanning circuit without using shift registers. Here, n is an integer not smaller than one, m and l are integers not smaller than two. With the image display device, sampling of video signals is surely executed without increasing the number of shift registers. It is thus possible to reduce the size and weight of the image display device and to decrease the defect rate thereof. Moreover, the scanning circuit achieves a higher yield compared with a conventional scanning circuit using a shift register.

26 Claims, 38 Drawing Sheets

U.S. PATENT DOCUMENTS

| | | | |
|---|---|---|---|
| 4,818,978 | 4/1989 | Kurihara et al. | 345/164 |
| 4,958,319 | 9/1990 | von Basse et al. | 365/154 |
| 5,166,671 | 11/1992 | Maekawa | 345/100 |
| 5,170,155 | 12/1992 | Plus et al. | 345/100 |
| 5,194,853 | 3/1993 | Asada | 345/100 |
| 5,243,333 | 9/1993 | Shiba et al. | 345/100 |
| 5,319,381 | 6/1994 | Mourey et al. | 345/100 |
| 5,396,261 | 3/1995 | Hastings, III | 345/92 |
| 5,396,262 | 3/1995 | Hastings, III | 345/92 |
| 5,404,151 | 4/1995 | Asada | 345/100 |
| 5,430,461 | 7/1995 | Tsai | 345/100 |
| 5,432,529 | 7/1995 | Azuhata | 345/100 |
| 5,434,599 | 7/1995 | Hira et al. | 345/100 |
| 5,526,015 | 6/1996 | Tsuboyama | 345/97 |
| 5,568,163 | 10/1996 | Okumura | 345/100 |
| 5,574,475 | 11/1996 | Callahan, Jr. et al. | 345/100 |
| 5,581,273 | 12/1996 | Yoneda et al. | 345/90 |
| 5,598,180 | 1/1997 | Suzuki et al. | 345/100 |
| 5,627,557 | 5/1997 | Yamaguchi et al. | 345/90 |
| 5,796,390 | 8/1998 | DuPont et al. | 345/204 |

IMAGE DISPLAY SCANNING CIRCUIT WITH OUTPUTS FROM SEQUENTIALLY SWITCHED PULSE SIGNALS

This is a divisional of application Ser. No. 08/363,217, filed Dec. 23, 1994, now U.S. Pat. No. 5,712,653.

FIELD OF THE INVENTION

The present invention relates to an image display device such as an active-matrix liquid crystal display device, and more particularly relates to a data-signal-line driving circuit and a scanning circuit for use in such an image display device.

BACKGROUND OF THE INVENTION

An active-matrix driving method is a well-known conventional method for driving an image display device.

As illustrated in FIG. 36, an image display device driven by the active-matrix driving method includes pixel arrays, a scanning-signal-line driving circuit GD, and a data-signal-line driving circuit SD.

The pixel arrays include a number of scanning signal lines $GL_i$, $GL_{i+1}$ . . . and a number of signal lines $SL_i$, $SL_{i+1}$ . . . , arranged in rows and columns. Pixels are arranged between the scanning signal lines $GL_i$, $GL_{i+1}$ . . . and the signal lines $SL_i$, $SL_{i+1}$ . . . in a matrix.

The data-signal-line driving circuit SD samples an input video signal DATA in synchronism with a timing signal TIMING, and sends a video signal obtained by sampling to the data signal lines $SL_j$, $SL_{j+1}$ . . . after amplifying the obtained video signal if necessary.

The scanning-signal-line driving circuit GD successively selects a scanning signal line from the scanning signal lines $GL_i$, $GL_{i+1}$ . . . in synchronism with the timing signal so as to control the open/closed state of a switching signal element in the pixel. As a result, the data on the data signal lines $SL_j$, $SL_{j+1}$ is written and retained in the respective pixels.

If the image display device is a liquid crystal display device, as illustrated in FIG. 37, each pixel has a switching element SW such as MOSFET (electric field effect transistor) and a pixel capacitor (including a liquid crystal capacitor Cl, and an auxiliary capacitor Cs which is added if necessary).

When MOSFET is adopted as the switching element SW, the data signal line $SL_j$ is connected to one of the electrodes of the pixel capacitor through the drain and source of the MOSFET. The gate of the MOSFET is connected to the scanning signal line GL. The other electrode of the pixel capacitor is connected to a common electrode line which is common to all the pixels. The transmittance and the reflectance of liquid crystal is modulated by a voltage applied to the liquid crystal capacitor Cl to display an image.

In a conventional active-matrix liquid crystal display device, an amorphous silicon thin film on a transparent substrate is used as the switching element SW, and externally mounted ICs are used as the scanning-signal-line driving circuit GD and data-signal-line driving circuit SD.

With a recently reported technique for achieving a large-screen liquid crystal display device, pixel arrays and driving circuits can be monolithically formed on a polycrystalline silicon thin film. However, since a carrier mobility in a polycrystalline silicon thin-film transistor is smaller by a substantially one-order scale than that in a single crystal silicon transistor, the driving force is considerably decreased. If a driving circuit is constructed using a transistor of low performance, there is a possibility that data is not written.

The following description discusses in detail the data-signal-line driving circuit SD and the scanning-signal-line driving circuit GD.

There are two methods for driving the data signal line: one is a dot sequential driving method and the other is a line sequential driving method.

With the dot sequential driving method, as illustrated in FIG. 38, video signals input to a video signal input line SIG are written on data signal lines DL1, DL2 . . . by opening and closing analog switches AS in synchronism with output pulses from the respective stages in the shift register SR. Therefore, the time used for writing the video signals on the data signal lines DL1 and DL2 . . . is given by $t_{He}/n$ where $t_{He}$ is an effective horizontal scanning period (about 80% of a horizontal scanning period). Consequently, if the time constants (the product of capacitance and resistance) of the data signal lines DL1, DL2 . . . increase with an enlargement of the display size, the data may not be written completely, resulting in degraded display quality. The degradation of display quality tends to occur particularly when the analog switches AS are formed by transistors with small driving forces.

With the line sequential driving method, as illustrated in FIG. 39, video signals in the current horizontal scanning period are temporarily stored in a sampling capacitor $C_{sa}$, and then the video signals are output to the data signal lines DL1, DL2 . . . through buffers (operational amplifiers) AMP in the next horizontal scanning period. Since the capacitance of the sampling capacitor $C_{sa}$ is usually smaller than that of each of the data signal lines DL1, DL2 . . ., writing of the video signals from a video input signal line SIG to the sampling capacitors $C_{sa}$ is carried out within a short time. Moreover, since the video signals are written to the data signal lines DL1, DL2 . . . having a larger load in the next horizontal scanning period, the data is completely written.

However, if the capacitance of the sampling capacitor $C_{sa}$ is increased so as to prevent a decrease in the charge retained in the sampling capacitor $C_{sa}$ due to leakage currents of the analog switches AS1 and AS2 and dividing charge in proportion to the capacitance when transmitted to the buffers AMP, the data can not be written accurately like in the case where the dot sequential driving method is used.

In order to solve the problems, as illustrated in FIG. 40, a data-signal-line driving circuit disclosed in Japanese Publication for Examined Patent Application No. 22917/1993 includes three shift registers SR1 to SR3 which are connected to (3n+1)th, (3n+2)th and (3n+3)th analog switches AS among the analog switches AS for sampling video signals, respectively. Here, n represents 0, 1, 2 . . . .

In this driving circuit, the three shift registers SR1 to SR3 are driven by clock signals CLK1 to CLK3 whose frequencies are reduced to one third of an original operational frequency and whose phases are slightly shifted relative to each other. With this structure, data is definitely written even when a polycrystalline silicon thin-film transistor of a small driving force is used.

With the above-mentioned conventional structure, however, a plurality of shift registers are necessary, and the area occupied by the data-signal-line driving circuit and the cost of the image display device are respectively increased. Additionally, this structure prevents a compact and light weight image display device. In particular, when a polycrystalline silicon thin-film transistor is used, it becomes difficult to use minute elements as compared with an IC which is formed on a single crystal silicon substrate, resulting in an increase in the area occupied by the data-signal-line driving circuit. Furthermore, an increase in the number of elements raises the rate of defective elements.

In recent years, the transistor characteristics of the polycrystalline silicon thin-film transistor has been improved by the development of a solid phase growth technique, a laser annealing technique or a technique for achieving fine polycrystalline silicon materials. With the development, even when one shift register is used, the possibility of obtaining a required operational frequency is increased. However, since the load of the analog switches is raised by increases in the size of display device and the number of gray levels, it becomes difficult to write video signals definitely even when a polycrystalline silicon thin film transistor of improved characteristics is used.

FIG. 41 shows a scanning circuit for a matrix display device driving circuit which is used for the data-signal-line driving circuit SD and the scanning-signal-line driving circuit GD and for controlling the timing of sampling of video signals or the timing of switching between ON and OFF of a signal to be applied to a scanning signal line.

The scanning circuit uses a master-slave shift register 905. The shift register 905 transmits a pulse signal sent from a start pulse signal line 902 in one direction sequentially to output signal lines 903-1, 903-2 . . . based on a signal from a clock signal line 901.

As illustrated in FIG. 42, signals synchronous with the rise of the signal of the clock signal line 901 are output to odd-numbered output signal lines 903-1, 903-3, and 903-5. On the other hand, signals synchronous with the fall of the signal of the clock signal line 901 are output to even-numbered output signal lines 903-2, 903-4, and 903-6.

The ON periods of signals on adjacent signal lines, for example, 903-1 and 903-2 overlap each other. Therefore, by calculating the AND of the signals on adjacent output signal lines among the output signal lines 903-1, 903-2 . . . in AND circuits 906-1, 906-2 . . . and outputting the result to the output signal lines 904-1, 904-2 . . . , pulse signals whose timing varies depending on the output signal lines 904-1, 904-2 . . . are obtained.

More specifically, as illustrated in FIG. 43, the shift register includes inverters connected in series. With this configuration, if a transistor constructing the shift register 905 has a defect, transistors located in stages after the defective transistor do not operate properly.

Assuming that the shift register 905 has ten transistors per output, each of the AND circuits 906-1, 906-2 . . . is formed by six transistors and that the probability of a transistor being non-defective is $P(0 \leqq P \leqq 1)$, the probability that an output in Lth stage is correctly obtained is $P^{10\times(L+1)+6}$. At this time, the probability that outputs in the first stage to the Lth stage are correctly obtained is $P^{16\times L+10}$. Thus, when the number of stages in the shift register 905 increases, the probability that outputs are correctly obtained is lowered.

Moreover, if the display panel and the driving circuit are made as a single piece using the polycrystalline Si, the transistors are unlikely to operate properly due to different characteristics of the transistors and electrostatic breakdown, for example. As a result, the defect rate is considerably increased compared with that of ICs using single crystal.

Moreover, an image display device such as a three-panel projector requires a scanning circuit capable of performing bidirectional scanning. Namely, it is necessary to provide a shift register 905' for producing a bidirectional shift of pulse signal. In this case, since 16 transistors are necessary for each output stage, the probability that an output signal in the Lth stage in the scanning circuit is obtained is $P^{16\times(L+1)+6}$. Namely, the probability becomes lower than the probability obtained by a scanning circuit performing unidirectional scanning.

Japanese Publication for Examined Patent Application No. 13316/1990 discloses a method with which the defect rate is decreased by arranging the same circuits in parallel and disconnecting a circuit having a defect.

With this method, however, since the sizes of the circuits are increased by two times, the defective area also becomes twice larger. Moreover, since it is necessary to identify and disconnect a defective circuit, a long time is taken for inspecting and fixing the defective circuit, resulting in a lowering of the productivity.

On the other hand, Japanese Publication for Examined Patent Application No. 70157/1993 discloses a method with which a plurality of sampling switches are connected in series and sampling is performed without using a shift register by controlling the sampling switches to be ON and OFF by different signals. With this structure, it is possible to reduce the number of lines for connecting portions of a data-signal-line driving circuit which are integrally mounted on a display panel to portions thereof which are mounted separately from the display panel.

With this method, however, since a plurality of the sampling switches are connected in series, ON resistance is increased. In order to decrease the ON resistance, it is necessary to increase the sizes of transistors constituting the sampling switches. As a result, the size of the circuit is increased.

Moreover, since a great number of large transistors are connected to a signal line for controlling the sampling switches between ON and OFF, a delay is caused by the load of the transistors. In addition, since this method is applicable only to a circuit for driving data signal lines, it can not be used for a circuit for driving scanning signal lines.

Furthermore, for example, as shown in FIG. 45, when displaying images satisfying the XGA (extended graphic array) standard (horizontal scanning lines 1024×vertical scanning lines 768) on an image display device for displaying images satisfying the HDTV (high-definition television) standard (horizontal scanning lines 1840×vertical scanning lines 1035), there is a need to scan through right and left areas of the display panel where no image is displayed to an area where the next display data is to be displayed during the flyback period. It is thus necessary to scan at an increased operational frequency during the flyback period. Additionally, as illustrated in FIG. 46, when displaying images at a usual operational frequency, it is necessary to add a selector for selecting an input position of a start pulse for controlling an input position of a leading signal for performing displaying. Consequently, driving circuits are increased in size.

In order to solve such a problem, Paper TA9.1 of ISSCC 94 (1994 IEEE International Solid-State Circuits Conference) proposes a scanning circuit incorporating a decoder. With this method, however, since a large number of transistors are used, the circuit has an increased size.

SUMMARY OF THE INVENTION

An object of the present invention is to provide an image display device including a data-signal-line driving circuit capable of surely executing sampling of video signals without unnecessarily increasing the number of shift registers.

In order to achieve this object, an active-matrix image display device of the present invention includes:

a plurality of data signal lines arranged in columns;

a plurality of scanning signal lines arranged in rows;

pixel arrays formed by pixels arranged in intersections of the data signal lines and the scanning signal lines;

a data-signal-line driving circuit for supplying video signals to the data signal lines; and a scanning-signal-line driving circuit for supplying scanning pulses to the scanning signal lines, wherein n series of clock signal and n×m series of video input signals are input to the data-signal-line driving circuit, the data-signal-line driving circuit includes n shift registers and analog switches for sampling the video input signals, and the analog switches are controlled by a result of a logic operation of output pulses from a plurality of stages in the shift registers. Here, n is an integer not smaller than one, and m is an integer not smaller than two.

With this structure, since the number (n) of the shift registers is larger than the number (n×m) of the video input signals, the sampling of the video signals is surely executed even when one shift register is used. It is therefore possible to reduce the area occupied by the driving circuits without lowering the display quality. As a result, the size and weight of the image display device are decreased, and the defect rate thereof is lowered.

Another object of the present invention is to provide a scanning circuit capable of decreasing the defect rate and improving the yield with a simplified circuit structure.

In order to achieve the above object, a scanning circuit for the matrix display device driving circuit of the present invention includes:

m lines of pulse signal lines for use in inputting signals;

l lines of output signal lines for use in outputting pulses; and switching means for sequentially switching signals to be output to the output signal lines between ON and OFF according to signals input to the pulse signal lines, wherein the switching means switches the signals to be output to the output signal lines between ON and OFF by a logic operation based on the signals input to n lines of the pulse signal lines among the m lines of the pulse signal lines, and a combination of the n lines of pulse signal lines for use in the logic operation varies among the output signals lines, n satisfying a condition of $mCn \geqq l$.

With this structure, since a shift register is not used, the possibility of output signals being obtained from the output signal lines is significantly increased compared with a conventional scanning circuit using a shift register. Moreover, since the scanning circuit of the present invention has a simplified structure compared with the conventional circuit, a higher yield is achieved.

For a fuller understanding of the nature and advantages of the invention, reference should be made to the ensuing detailed description taken in conjunction with the accompanying drawings.

BRIEF DESCRIPTION OF THE DRAWINGS

FIG. 25(*a*) is a circuit diagram showing the internal structure of the 3-input dynamic NAND circuit of FIG. 24, and FIG. 25(*b*) is a circuit diagram showing the internal structure of the 3-input dynamic NOR circuit of FIG. 24.

FIG. 35(*b*) is a circuit diagram showing another structure for retaining a voltage of an output signal line of a scanning circuit.

DESCRIPTION OF PREFERRED EMBODIMENTS

Referring to FIGS. 1 to 13, the following description discusses one embodiment of a data-signal-line driving circuit in an image display device of the present invention.

Figure 1:
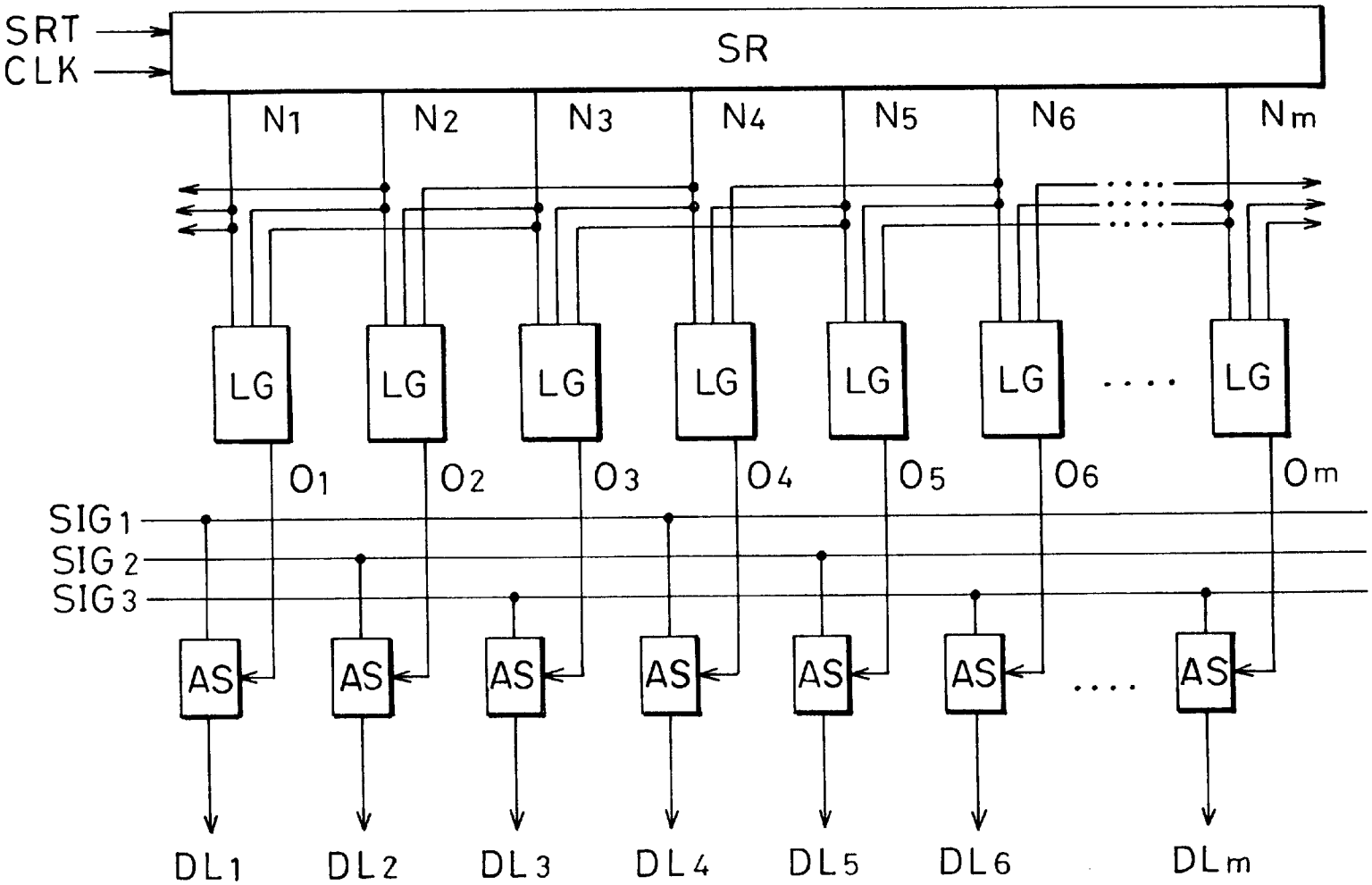
FIG. 1 is a block diagram illustrating a structure of a data-signal-line driving circuit in an image display device of the present invention.

As illustrated in FIG. 1, the data-signal-line driving circuit of this embodiment includes a shift register SR, m logic circuits LG, and m analog switches AS. The shift register SR sequentially outputs pulse signals to outputs N1, N2, N3 . . . in m stages in synchronism with a clock signal CLK. The logic circuits perform a logic operation based on outputs Ni, Ni+1 and Ni+2 (i: positive integer) in neighboring three stages in the shift register SR, and output the result. The analog switches AS connect data signal lines DL1, DL2, DL3 . . . to any of three lines of image input signal lines SIG1 to SIG3 based on signals from outputs O1, O2, O3 . . . of the logic circuits LG.

Figure 11:
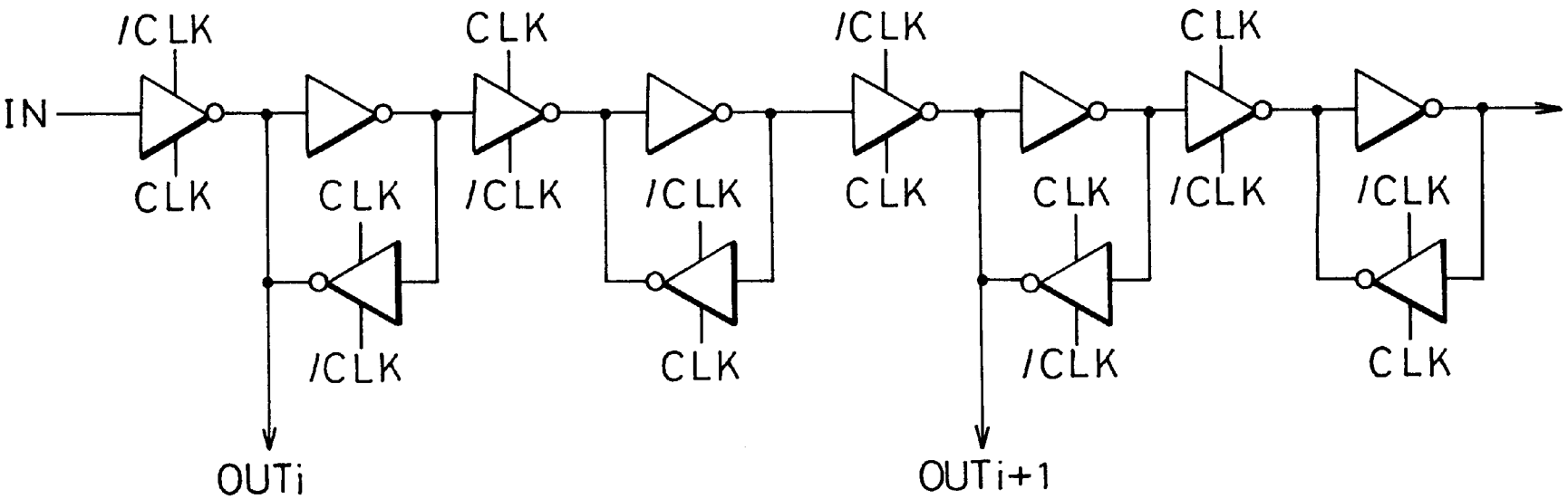
FIG. 11 is a circuit diagram showing an example of a shift register.
Figure 13:
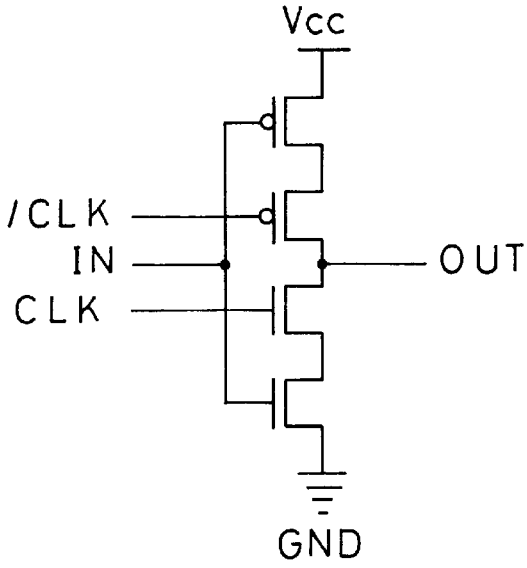
FIG. 13 is a circuit diagram showing an example of a clocked inverter in the shift registers of FIGS. 11 and 12.

FIG. 11 illustrates an example of an actual shift register SR. In FIG. 11, only two stages among the outputs N1, N2, N3 to Nm in the m stages are shown. FIG. 13 illustrates an example of an inner circuity in a clocked inverter used in the circuit of FIG. 11.

Figure 2:
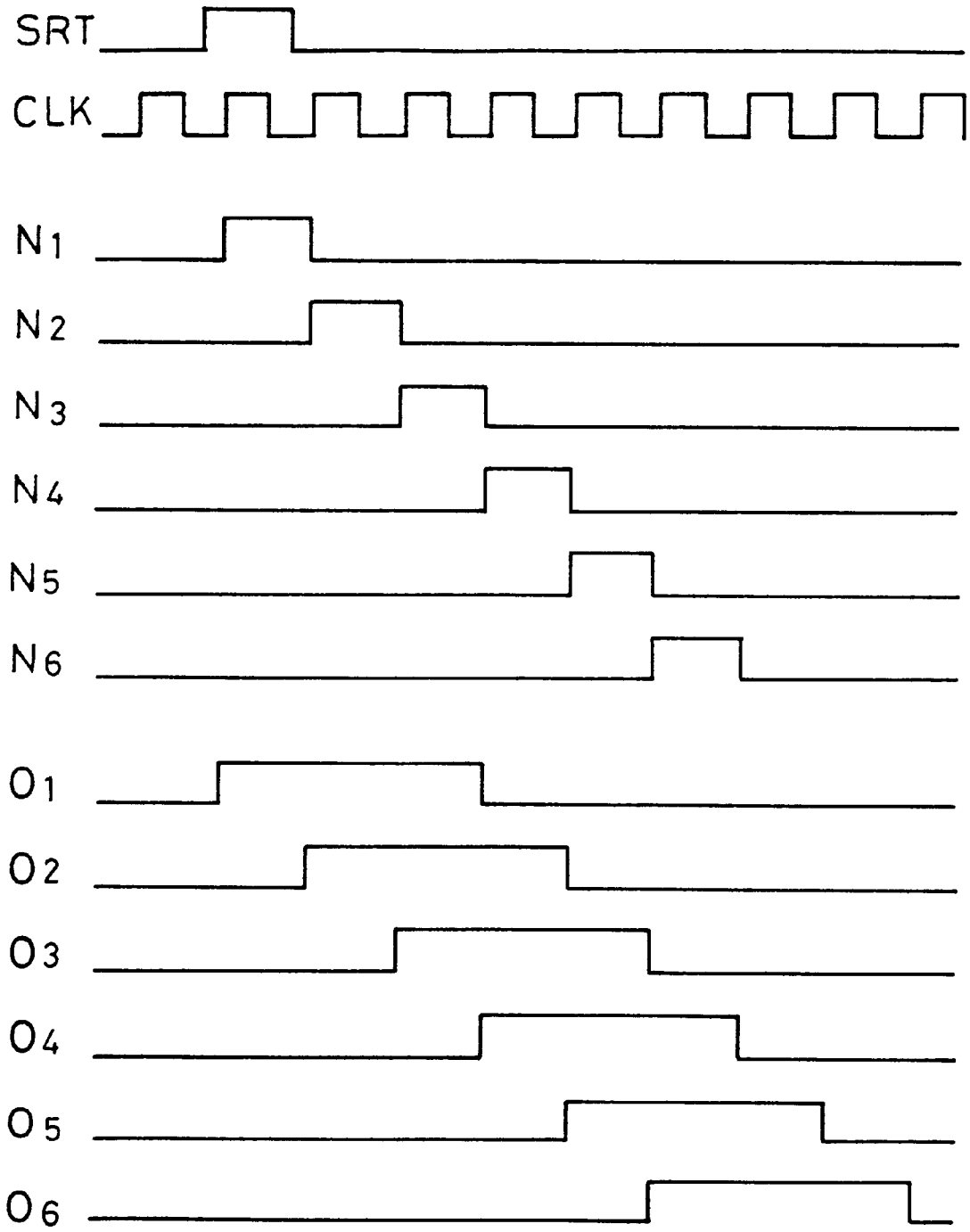
FIG. 2 shows the waveforms of signals on signal lines in the data-signal-line driving circuit of FIG. 1.

With this structure, pulses are sequentially output from the respective stages of the shift register SR to the outputs N1, N2, N3 . . . according to start pulses SRT and the clock signal CLK as shown in FIG. 2. The logic circuit LG generates a pulse having a width three times larger than that of a pulse from the output Ni by carrying out the logical OR among the three outputs Ni, Ni+1 and Ni+2 of the shift register SR, and outputs the pulse to an output Oi.

The pulse whose width is three times larger than that of the pulse from the output Ni overlaps the two pulses before and behind. Therefore, if one series of video signals is sampled by controlling the analog switches AS using the pulse, adjacent pixel information is mixed, and a display problem may occur. In order to prevent such a problem, three series of video signals from the video input signal lines SIG1 to SIG3 are sampled. It is preferable to input data of a (3m−2)th pixel, a (3m−1)th pixel and a (3m)th pixel (m: positive integer) to the video input signal lines SIG1 to SIG3 after extending the time thereof by three times.

Since the correlation between adjacent pixels is usually strong, even if one series of video signals is used, it is possible to write substantially accurate data to the data signal lines DL1, DL2 . . . This is achieved by writing approximate potential levels in the beginning two thirds of a sampling period and precise potential levels in the remaining one third of the sampling period.

Figure 3:
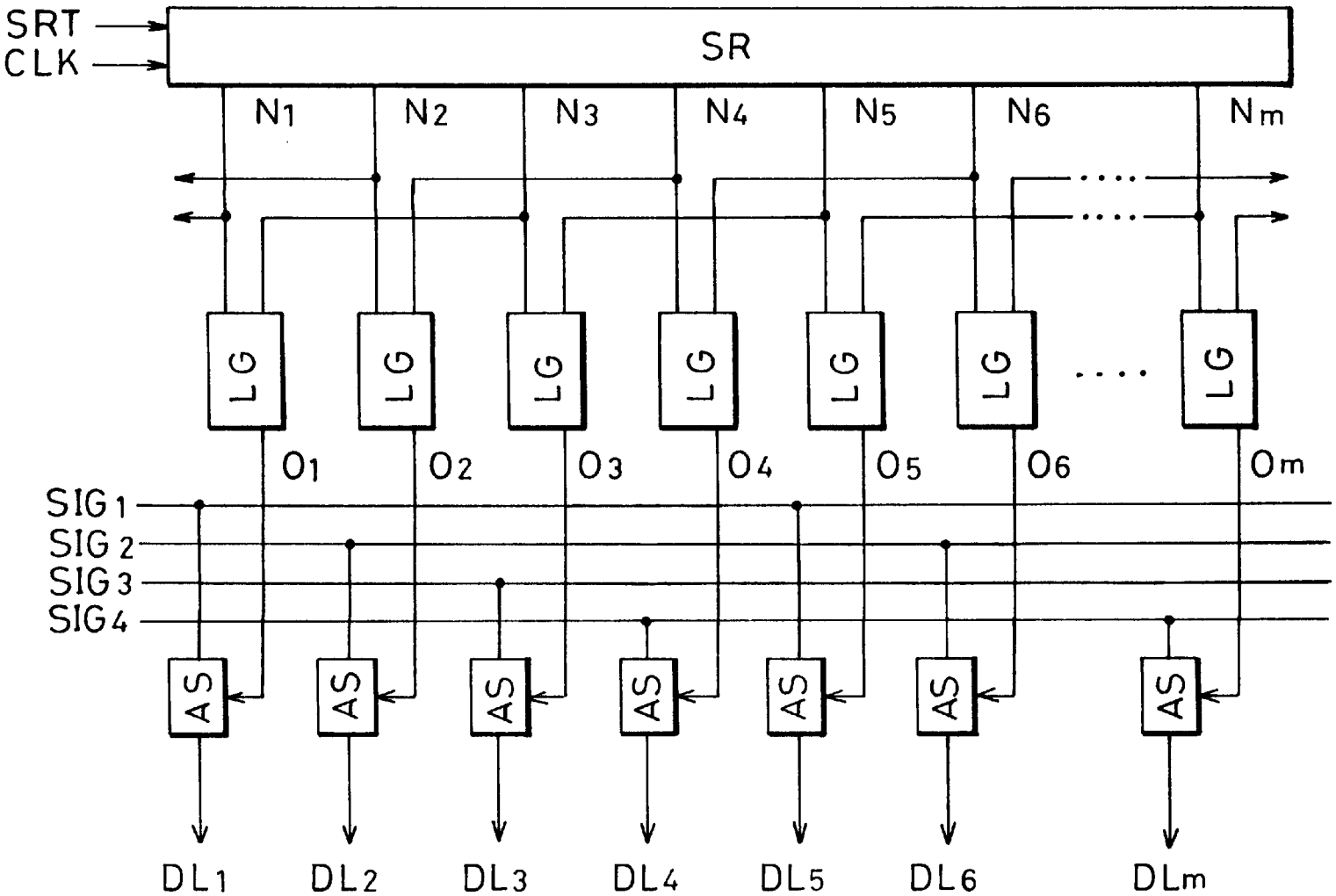
FIG. 3 is a block diagram illustrating another structure of the data-signal-line driving circuit in the image display device of the present invention.

Referring now to FIG. 3, the following description discusses another embodiment of the data-signal-line driving circuit of the image display device of the present invention.

The data-signal-line driving circuit of this embodiment includes a shift register SR, m logic circuits LG, and m analog switches AS. The shift register SR sequentially outputs pulse signals to the outputs N1, N2, N3 . . . in the m stages in synchronism with clock signal CLK. The logic circuits LG perform a logic operation based on the two outputs Ni and Ni+2 of the shift register SR, and output the result. The analog switches AS connect data signal lines DL1, DL2, DL3 . . . to one of four lines of image input signal lines SIG1 to SIG4 according to signals from the outputs O1, O2, O3 . . . of the logic circuits LG.

Figure 12:
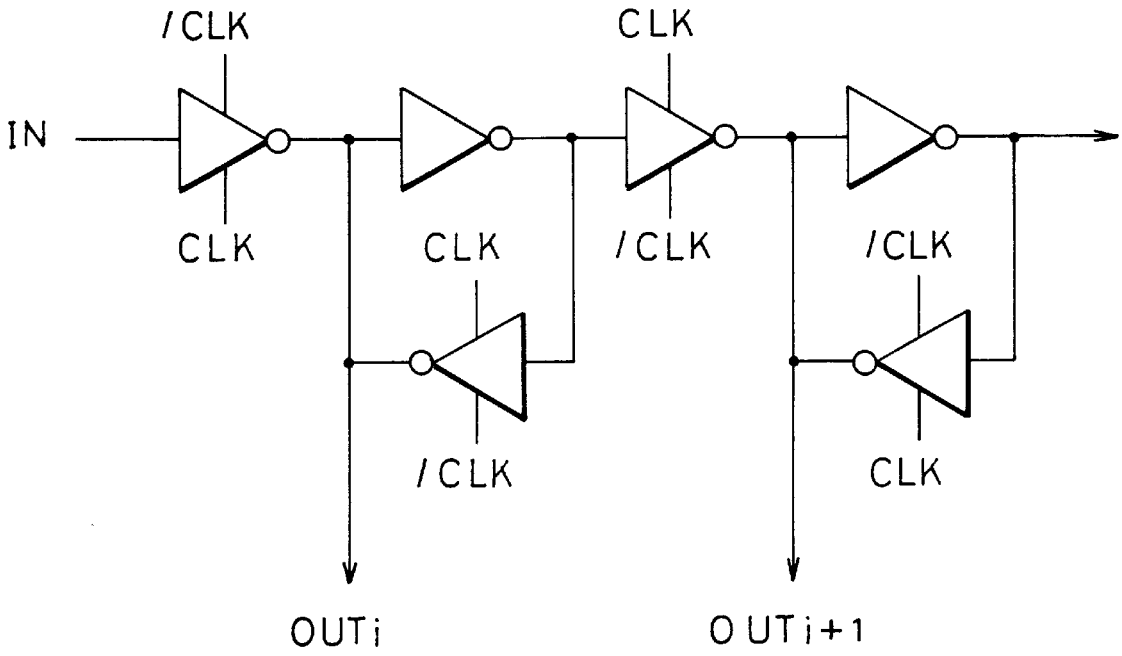
FIG. 12 is a circuit diagram showing another example of a shift register.

FIG. 12 illustrates an example of an actual circuit of the shift register SR. In FIG. 12, only two stages among the outputs N1, N2, N3 to Nm in the m stages are shown. A clocked inverter used in this circuit is the same as that used in the above-mentioned circuit.

Figure 4:
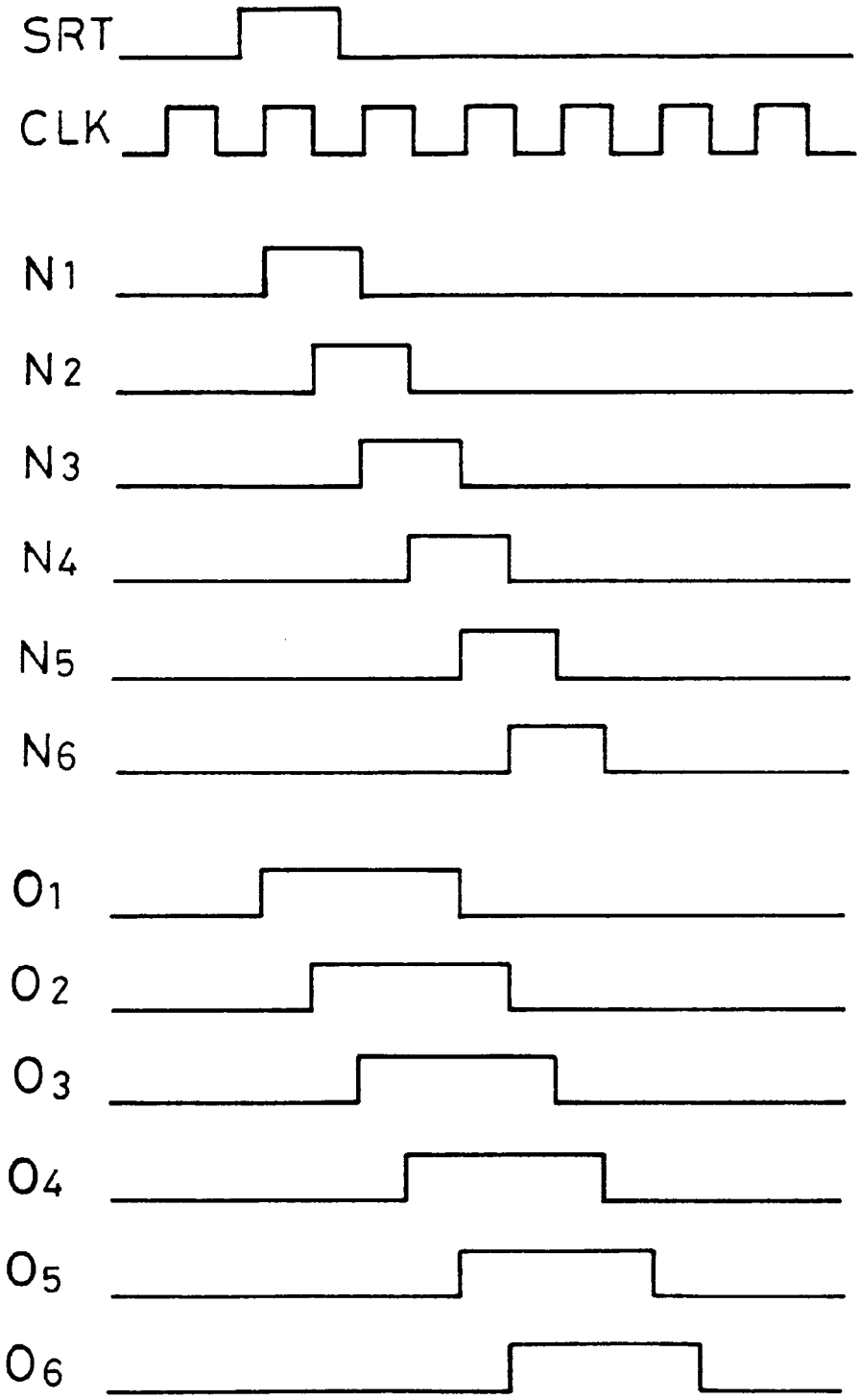
FIG. 4 shows the waveforms of signals on signal lines in the data-signal-line driving circuit of FIG. 3.

With this structure, pulses are sequentially output from the respective stages of the shift register SR to the outputs N1, N2, N3 . . . based on the start pulses SRT and the clock signal CLK as shown in FIG. 4. The logic circuit LG generates a pulse having a width twice larger than that of a pulse from the output Ni by carrying out the logical OR between every other outputs Ni and Ni+2 of the shift register SR, and outputs the pulse to the output Oi.

The pulse whose width is twice larger than that of the pulse from the output Ni overlaps three pulses before and three pulses behind. Therefore, if one series of video signals is sampled by controlling the analog switches AS using the pulse, adjacent pixel information is mixed, and a display problem may occur. In order to prevent such a problem, four series of video signals from the video input signal lines SIG1 to SIG4 are sampled. It is preferable to input data of a (4m−3)th pixel, a (4m−2)th pixel, a (4m−1)th pixel and (4m)th pixel to the video input signal lines SIG1 to SIG4 after extending the time thereof by four times.

Since the correlation between adjacent pixels is usually strong, even if one series of video signals is used, it is possible to write substantially accurate data to the data signal lines DL1, DL2 . . . This is achieved by writing approximate potential levels in the beginning three quarter of a sampling period and precise potential levels in the remaining one quarter of the sampling period.

In the above-mentioned two embodiments, the output pulses of the shift register SR have a positive polarity, and the logic circuit LG is an OR circuit for generating an OR output. The OR circuit is usually formed by a combination of a NAND circuit and an inverter.

Each of the analog switches AS is formed by an N-channel transistor or a P-channel transistor. In order to accurately transmit video signals in a wide voltage range, it is preferable to construct a CMOS switch by connecting the N-channel transistor and the P-channel transistor in parallel. The same can also be said to the following embodiments.

It is possible to form another embodiment similar to the above-mentioned embodiments by using a data-signal-line driving circuit including a shift register SR whose output pulses have a negative polarity and a logical circuit LG formed by an AND circuit for generating an AND output. The AND circuit is usually formed by a combination of a NOR circuit and an inverter.

In this case, it is necessary to control an analog switch to be opened and closed by a signal of a negative polarity. However, if the analog switch is formed by the CMOS switch as described above, it is only necessary to reverse the gate inputs of the N-channel transistor and the P-channel transistor.

In the above-mentioned embodiments, an OR circuit or an AND circuit is used for the logic circuit LG. However, in a conventional CMOS logic circuit, it is easier to generate a NAND output or a NOR output than an OR output or an AND output, and therefore a reduction in the size of the circuit is achieved. Namely, it is preferable to construct the logic circuit LG by a NAND circuit or a NOR circuit as explained in the following embodiments. The structure and the waveform of a data-signal-line driving circuit using a circuity shown in FIG. 11 as the shift register SR will be explained as an example in the following embodiments. However, similar effects will also be produced by using a circuity shown in FIG. 12.

Figure 5:
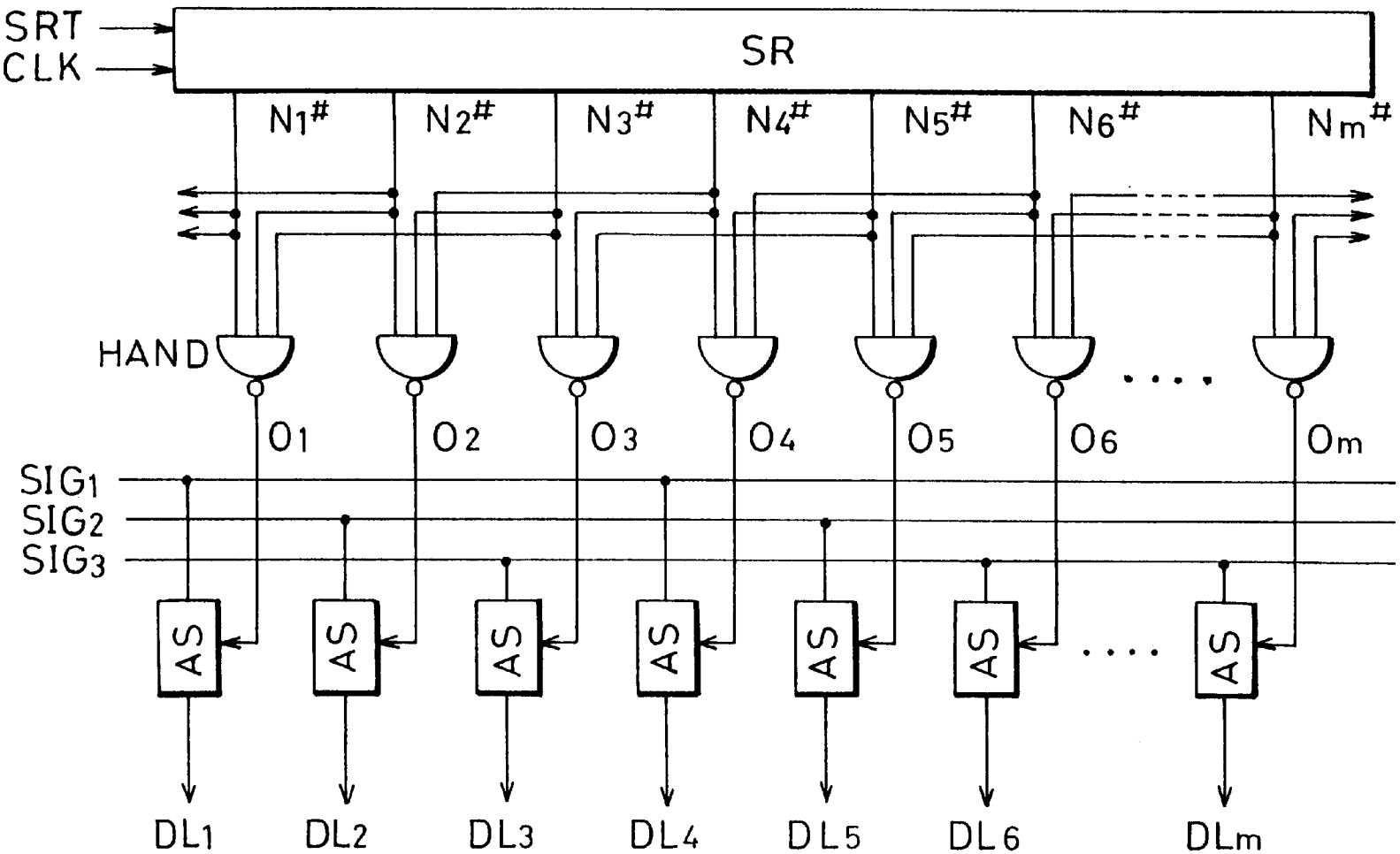
FIG. 5 is a block diagram illustrating still another structure of the data-signal-line driving circuit in the image display device of the present invention.

Referring now to FIG. 5, the following description discusses another embodiment of the data-signal-line driving circuit of the image display device of the present invention.

The data-signal-line driving circuit of this embodiment includes a shift register SR for outputting a pulse of a negative polarity, and logic circuits NAND for outputting the NAND of the three outputs Ni, N(i+1)# and N(i+2)# of the shift register SR. For example, a dynamic NAND circuit is used as the logic circuit NAND.

Figure 7:
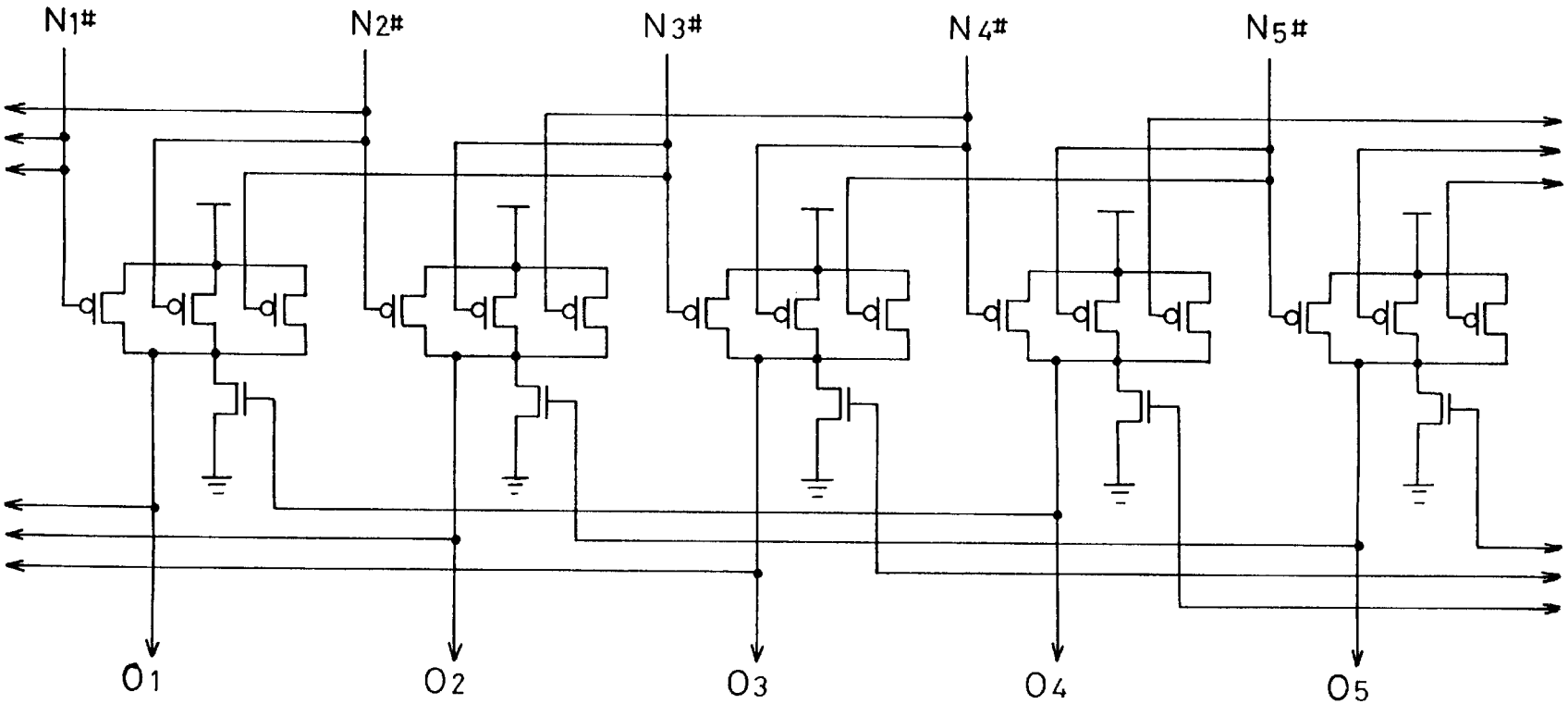
FIG. 7 is a circuit diagram of a dynamic NAND circuit as an example of a logic circuit in the data-signal-line driving circuit of FIG. 5.

As illustrated in FIG. 7, the dynamic NAND circuit includes three P-channel MOS transistors which are connected in parallel, and one N-channel MOS transistor which is connected to these P-channel MOS transistors in series.

The negative outputs Nit, N(i+1)# and N(i+2)# from the shift register SR are input to gate electrodes of the three P-channel MOS transistors, respectively. An output Oi+3 from the NAND circuit located three stages ahead is input to a gate electrode of the N-channel MOS transistor.

With this structure, when one of the three P-channel MOS transistors is turned on, the output Oi becomes high level, and then the analog switch AS is turned on. On the other hand, when all of the three P-channel MOS transistors are turned off, an output Oi+3 of the NAND circuit located three stages ahead becomes high level. This causes the N-channel MOS transistor to be turned on and the output Oi to be low level. As a result, the analog switch As is turned off.

Figure 6:
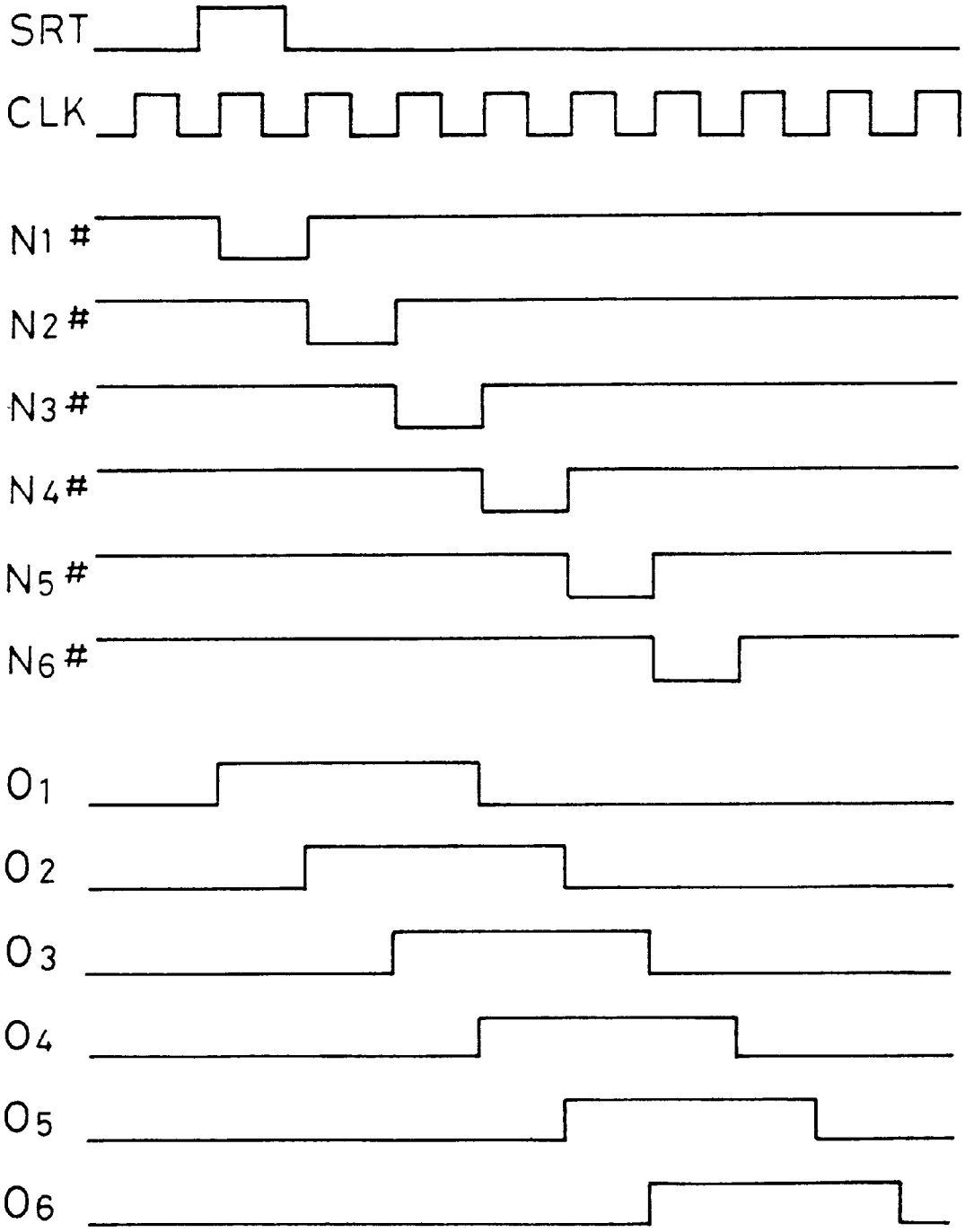
FIG. 6 shows the waveforms of signals on signal lines in the data-signal-line driving circuit of FIG. 5.

FIG. 6 shows the waveforms of the outputs N1#, N2# . . . of the shift register SR and the waveforms of the outputs O1, O2 . . . of the logic circuits NAND. It is known from FIG. 6 that the outputs O1, O2 . . . obtained are the same as those shown in FIG. 2.

Since the number of elements is decreased by using a dynamic NAND circuit as the logic circuit NAND, it is possible to reduce the area occupied by the data-signal-line driving circuit. When a NAND circuit has three inputs as described in this embodiment, if this is a static NAND circuit, six transistors are necessary. However, if a dynamic NAND circuit is used, only four transistors are required.

Figure 8:
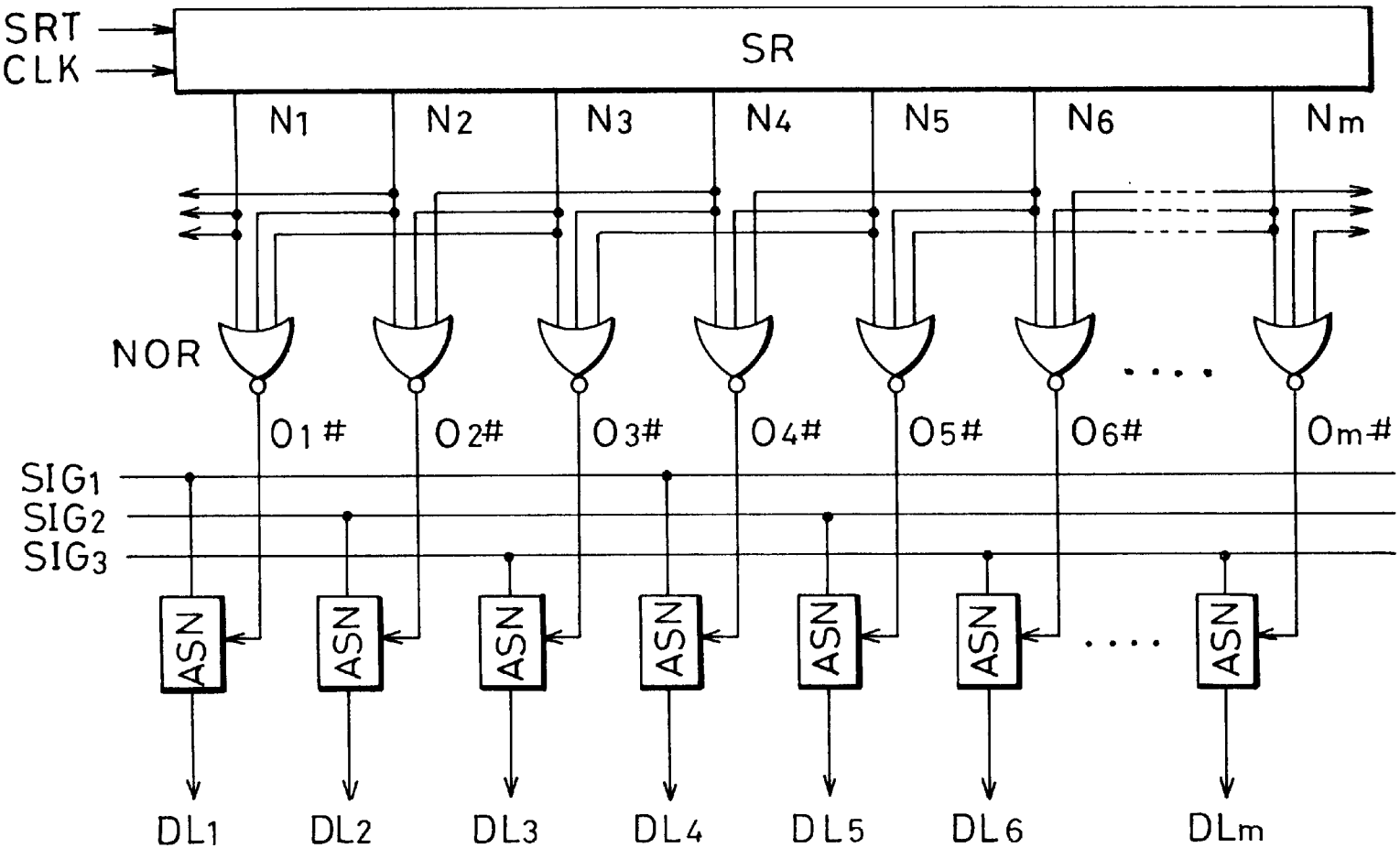
FIG. 8 is a block diagram illustrating still another structure of the data-signal-line driving circuit in the image display device of the present invention.

Another embodiment of the data-signal-line driving circuit of the image display device of the present invention will be explained below with reference to FIG. 8.

The data-signal-line driving circuit of this embodiment includes a shift register SR for outputting a pulse of a positive polarity, and logic circuits NOR for outputting the NOR of the three outputs Ni, N(i+1) and N(i+2) of the shift register SR. For example, a dynamic NOR circuit is used for the logic circuit NOR.

Figure 10:
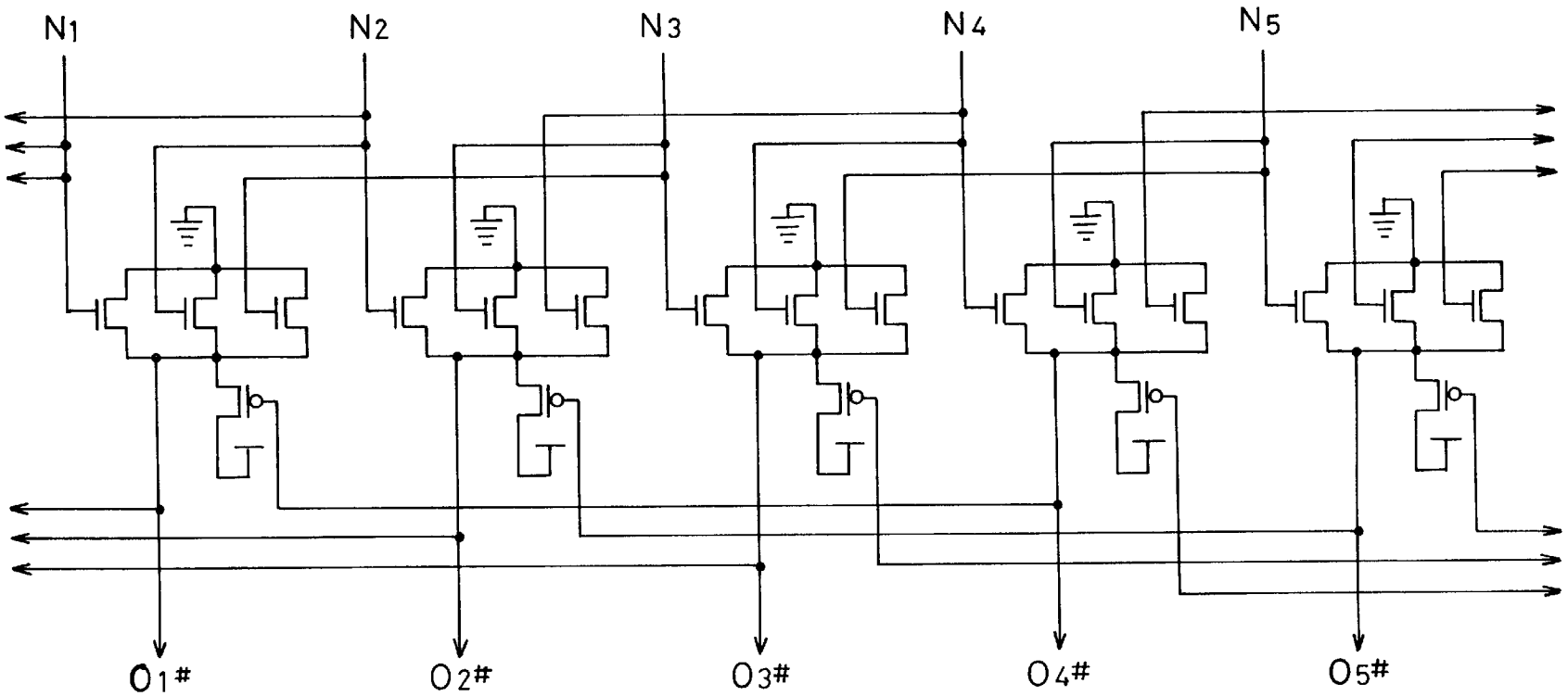
FIG. 10 is a circuit diagram of a dynamic NOR circuit as an example of a logic circuit in the data-signal-line driving circuit of FIG. 8.

As illustrated in FIG. 10, the dynamic NOR circuit includes three N-channel MOS transistors which are connected in parallel, and one P-channel MOS transistor which is connected to these N-channel MOS transistors in series.

The positive outputs Ni, N(i+1) and N(i+2) from the shift register SR are input to gate electrodes of the three N-channel MOS transistors, respectively. An output 0(i+3)# from the NOR circuit located three stages ahead is input to a gate electrode of the P-channel MOS transistor.

With this structure, when one of the three N-channel MOS transistors is turned on, an output Oi# becomes low level, and an analog switch ASN is turned on. On the other hand, when all of the three N-channel MOS transistors are turned off, the output O(i+3)# of the NCR circuit located three stages ahead becomes low level. This causes the P-channel MOS transistor to be turned on and the output Oi# to be high level. As a result, the analog switch ASN is turned off.

Figure 9:
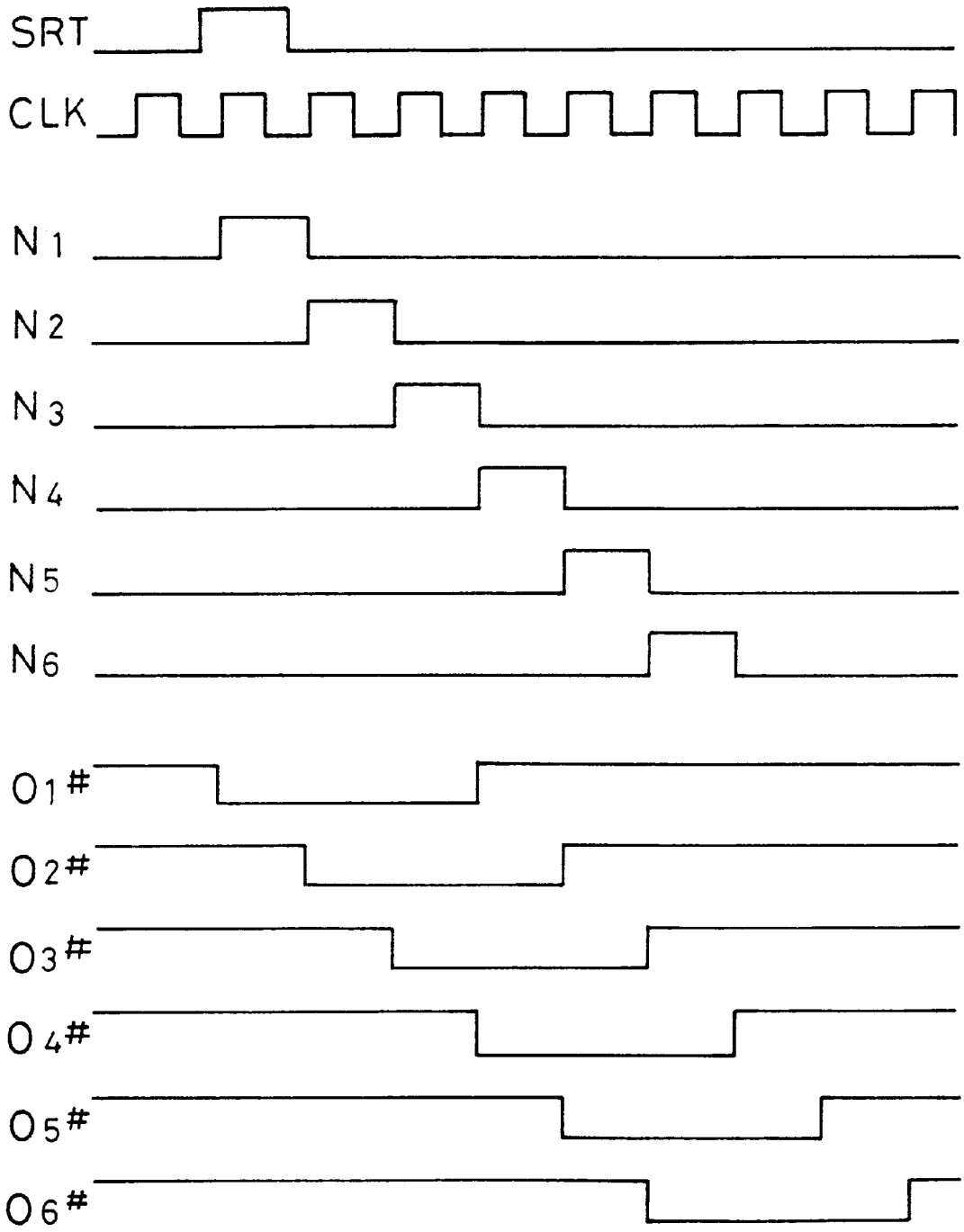
FIG. 9 shows the waveforms of signals on signal lines in the data-signal-line driving circuit of FIG. 8.

FIG. 9 shows the waveforms of the outputs N1, N2 . . . of the shift register SR and the waveforms of the outputs O1#, O2# . . . of the logic circuit NAND. It is known from FIG. 9 that the phase of the outputs O1#, O2# . . . is opposite to that shown in FIG. 2.

Since the number of elements is decreased by using a dynamic NOR circuit as the logic circuit NCR, it is possible to reduce the area occupied by the data-signal-line driving circuit. When a NOR circuit has three inputs as described in this embodiment, if this is a static NOR circuit, six transistors are necessary. However, if a dynamic NOR circuit is used, only four transistors are required.

In the above-mentioned embodiment, logic circuits (LG, NAND, NOR) for performing logic operations based on the outputs of the shift register SR may include one circuit or a plurality of circuits having inverting and amplification functions in addition to a circuit performing arithmetic operations. With this structure, it is possible to drive an analog switch having a large driving force by a relatively small shift register SR. If the circuit performing the inverting and amplification functions is added, the polarity of a control signal of the analog switch is reversed.

The data-signal-line driving circuits explained in the above-mentioned embodiments employ the dot sequential driving method in which video input signals are directly input to the data signal lines. However, the present invention is also applicable to a data-signal-line driving circuit employing the line sequential driving method.

Moreover, each of the data-signal-line driving circuits explained in the above-mentioned embodiments includes one shift register SR and performs polyphase sampling of more than one series of video signals. However, it is possible to construct the data-signal-line driving circuit to have n shift registers SR and sample video signals on a number (n×integer) of video input signal lines. It is also possible to use a combination of the data-signal-line driving circuits of the above-mentioned embodiments.

The image display device of the present invention is applicable not only to a liquid crystal display device which is formed by arranging pixel arrays, a scanning line driving circuit and a data-signal-line driving circuit on separate substrates, but also to a liquid crystal display device which is constructed by arranging one or both of the driving circuits on a substrate whereupon pixel arrays are formed.

The present invention produces particularly great effects when it is applied to a liquid crystal display device with an integrated driving circuit which is constructed by forming one or both of the driving circuits on a polycrystalline silicon thin film on a transparent substrate. The reason for this is that a polycrystalline silicon thin film transistor takes a longer time for sampling video signals using analog switches because the driving force thereof is smaller than that of a transistor formed on monocrystal.

In the above-mentioned embodiments, the present invention was explained by focusing on the application of the present invention to the active-matrix liquid crystal display device. However, it is also possible to apply the present invention to liquid crystal display devices of other types.

Referring now to FIGS. 14 to 35, the following description discusses one embodiment of a scanning circuit for a matrix display device driving circuit (i.e., for use in a data-signal-line driving circuit or a scanning-signal-line driving circuit in an image display device) of the present invention.

Figure 14:
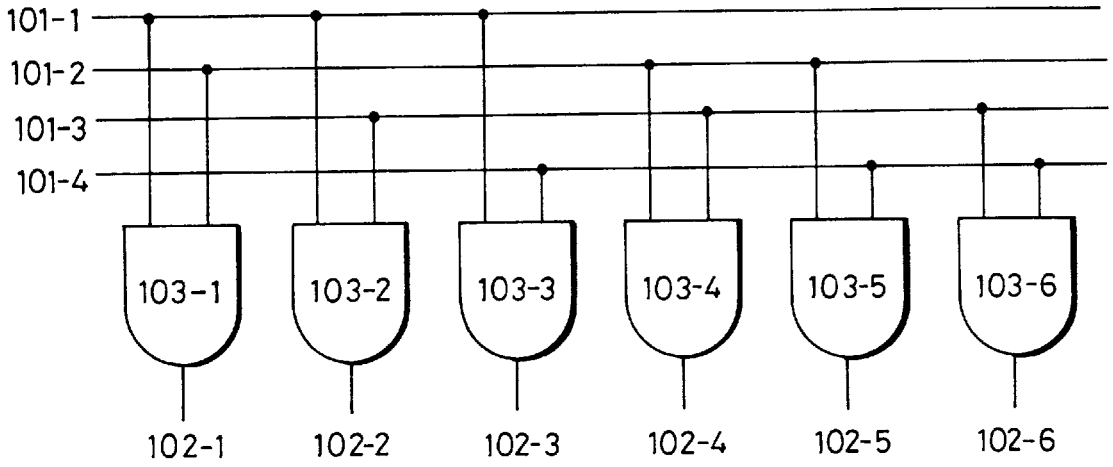
FIG. 14 is a block diagram showing a structure of a scanning circuit for use in a display device according to the present invention.
Figure 15:
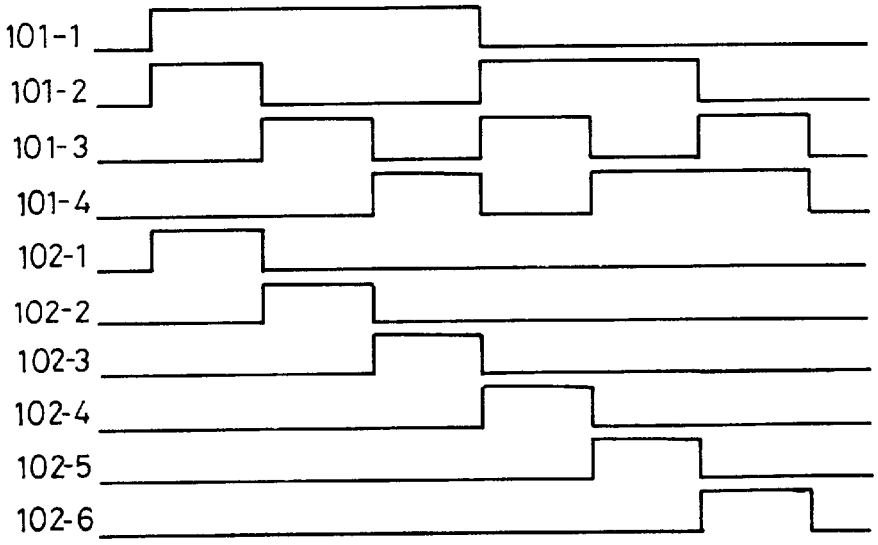
FIG. 15 illustrates the waveforms showing an example of input signals and outputs signal of the scanning circuit of FIG. 14.

FIG. 14 illustrates an example of the structure of the scanning circuit. FIG. 15 shows an example of the waveforms of signals of pulse signal lines 101-1 to 101-4 and output signal lines 102-1 to 102-6. In order to simplify the explanation thereof, m representing the number of the pulse signal lines is set 4, L representing the number of the output signal lines is set 6, and n representing the number of signal lines for controlling output signals is set 2. In an actual circuit, m=8 to 12, n=2 to 4, and L=60 to 200.

The number of available combinations in selecting n lines of pulse signal lines from m lines of pulse signal lines is mCn. Therefore, in order to prevent a plurality of output signal lines from being turned on simultaneously, it is necessary to satisfy the condition $L \leqq mCn$.

The AND circuit 103-1 outputs the AND of a signal of the pulse signal line 101-1 and a signal of the pulse signal line 101-2 to the output signal 102-1. Similarly, the AND circuit 103-2 outputs the AND of a signal of the pulse signal line 101-1 and a signal of the pulse signal line 101-3 to the output signal line 102-2. The AND circuit 103-3 outputs the AND of a signal of the pulse signal line 101-1 and a signal of the pulse signal line 101-4 to the output signal line 102-3. The AND circuit 103-4 outputs the AND of a signal of the pulse signal line 101-2 and a signal of the pulse signal line 101-3 to the output signal line 102-4. The AND circuit 103-5 outputs the AND of a signal of the pulse signal line 101-2 and a signal of the pulse signal line 101-4 to the output signal line 102-5. The AND circuit 103-6 outputs the AND of a signal of the pulse signal line 101-3 and a signal of the pulse signal line 101-4 to the output signal line 102-6.

With this arrangement, when pulse signals for switching on only two pulse signal lines among the four pulse signal lines 101-1 to 101-4 are input to the pulse signal lines 101-1 to 101-4, pulse signals whose ON periods differ from each other are output to the output signal lines 102-1 to 102-6.

The output signals on the output signal lines 102-1 to 102-6 are controlled only by an AND circuit formed by six transistors. Therefore, if the probability of one transistor being non-defective is P where $0 \leqq P \leqq 1$, the probability of outputs from the respective stages being correct is $P^6$. Then, the probability of outputs from all the stages being correct is $P^{3\times6}$.

On the other hand, like a conventional device, when the scanning circuit for use in a display device is constructed using a shift register, the probability of an output from the Lth stage being correct is $P^{10\times(L+1)+6}$. At this time, the probability of outputs from the first stage to the Lth stage being correct is $P^{16\times L+10}$.

Since $P^6 \geqq P^{10\times(1+1)+6}=P^{26} \geqq P^{10\times(6+1)+6}=P^{76}$, the probability that each stage of the scanning circuit for use in the display device of this embodiment is properly operated is higher than that of the conventional scanning circuit for use in a display device. Moreover, since $P^{6\times6}=P^{36} \geqq P^{10\times6+10}=P^{106}$, the probability that all the stages of the scanning circuit for use in a display device of this embodiment are properly operated is higher than that of the conventional scanning circuit for use in a display device. The equal sign is effective only when P=0 or P=1. However, this can never be achieved in reality. Thus, with the scanning circuit for use in a display device of this embodiment, it is certain that a higher yield is achieved compared with the conventional scanning circuit for use in a display device.

In the calculation of probability, it is assumed that signals supplied to the m lines of pulse signal lines are generated by a highly reliable external encoder.

Figure 16:
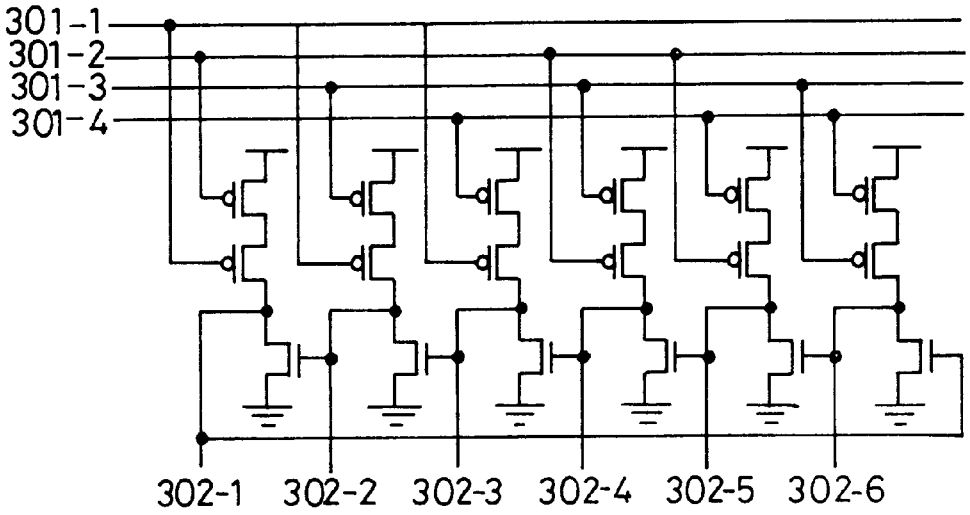
FIG. 16 is a circuit diagram showing another structure of the scanning circuit for use in a display device according to the present invention.

The circuit structure shown in FIG. 14 and the waveforms of signals shown in FIG. 15 merely illustrate one embodiment of the present invention. Namely, the circuit structure and the waveforms of signals are not restricted to those. For instance, it is possible to replace the AND circuit with the NOR circuit and reverse the polarities of the signals of the pulse signal lines. Since the NOR circuit is formed by four transistors, the defect rate is further decreased and the yield of the scanning circuit for use in a display device is further increased. It is possible to further reduce the number of elements if a dynamic NOR circuit is used as shown in FIG. 16.

It is known from the waveforms of signals shown in FIG. 15 that a plurality of pulse signals are simultaneously switched. Therefore, if a glitch occurs, a scanning signal may be output at a time other than a predetermined time. The glitch occurs when the difference in the delay time among the pulse signals on the pulse signal lines becomes larger due to increases in the characteristic difference among elements constituting the circuit for outputting pulse signals and in the parasitic capacitance and the resistance on the pulse signal lines.

Figure 17:
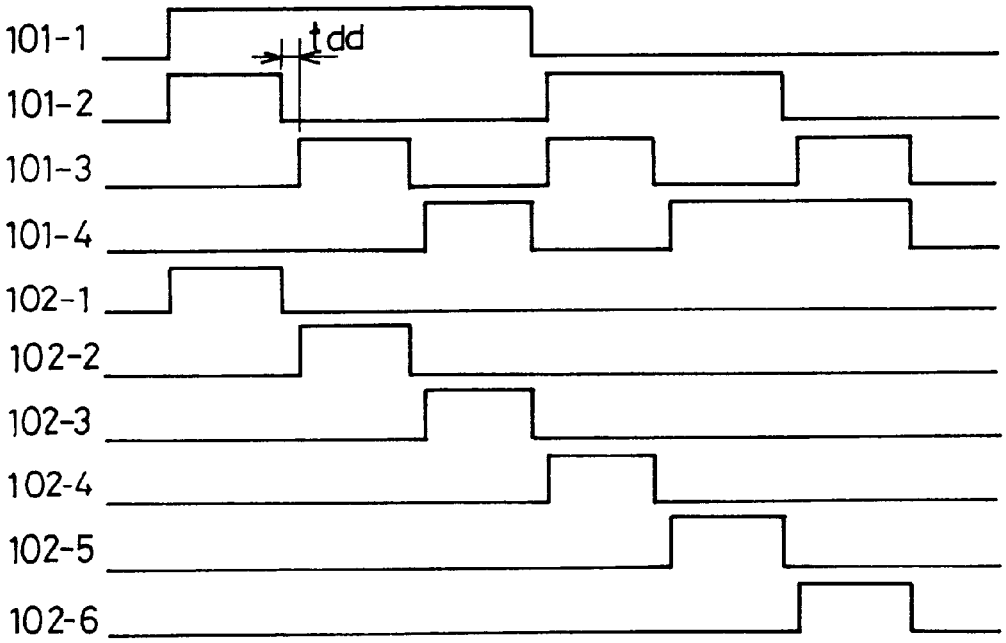
FIG. 17 illustrates the waveforms showing another example of input signals and outputs signal of the scanning circuit of FIG. 14.

Then, as illustrated in FIG. 17, it is possible to avoid the effect caused by the variations in the delay time by inputting signals to the m lines of pulse signal lines so that a signal on a pulse signal line is reset and signals on other pulse signal lines are set when a predetermined time $t_{dd}$ elapses after the reset of the pulse signal line.

Figure 18:
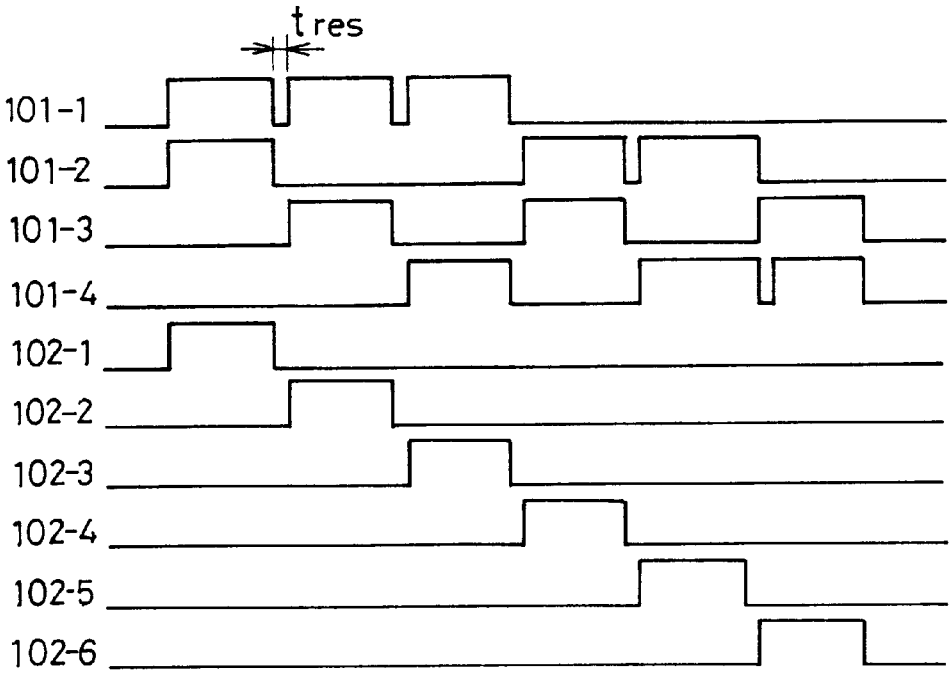
FIG. 18 illustrates the waveforms showing still another example of input signals and outputs signal of the scanning circuit of FIG. 14.

As illustrated in FIG. 18, it is also possible to avoid the effect caused by the variations in the delay time by resetting the set signals on the pulse signal lines for a period of time $t_{res}$ immediately before the combination of the set pulse signal lines is changed.

Figure 19:
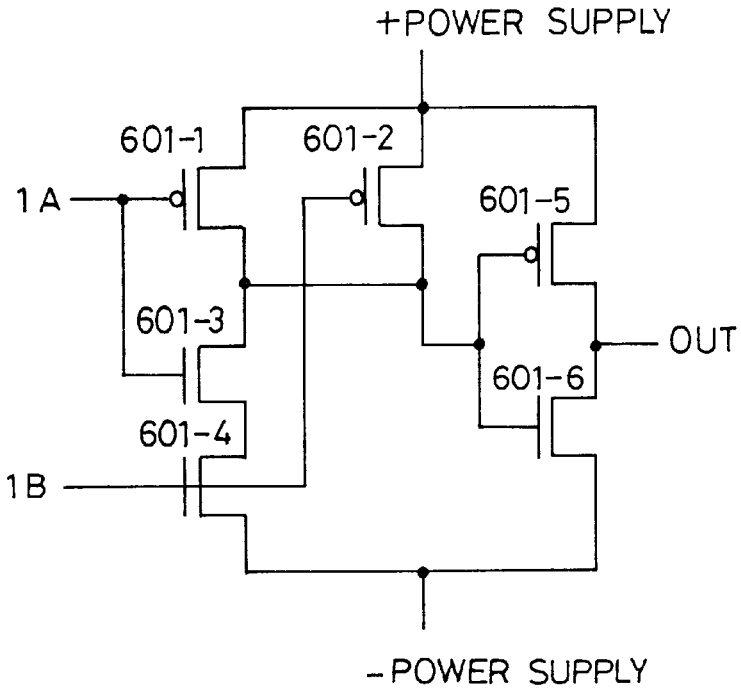
FIG. 19 is a circuit diagram showing an example of the structure of an AND circuit in the scanning circuit of FIG. 14.
Figure 20:
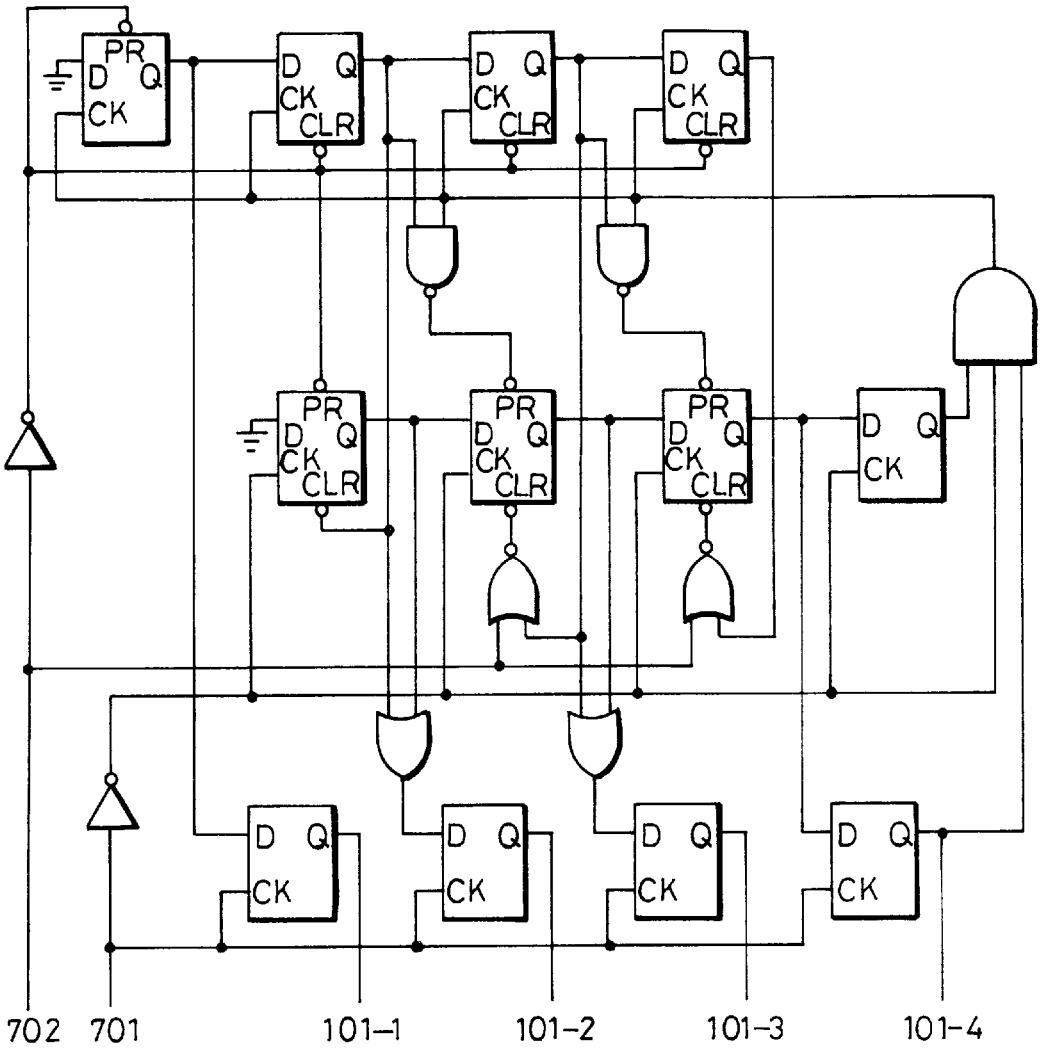
FIG. 20 is a block diagram showing an example of an encoder used in the scanning circuit of the present invention.

Moreover, as illustrated in FIG. 19, the time constant and the switching threshold voltage of the circuit may be adjusted so that the output signals are switched only when the state where the condition for a logical calculation is true is kept for a predetermined time by changing the channel size (the channel width Wp and Wn and the channel length Lp and Ln) in field effect transistors 601-1 to 601-6 constituting the AND circuits 103-1, 103-2 . . . as shown in Table 1.

TABLE 1

| Transistor | Channel width | Channel length |
|---|---|---|
| 601-1 | Wp × 2 | Lp |
| 601-2 | Wp × 2 | Lp |
| 601-3 | Wn | Ln × 2 |
| 601-4 | Wn | Ln × 2 |
| 601-5 | Wp | Lp × 2 |
| 601-6 | Wn × 2 | Ln |

Figure 21:
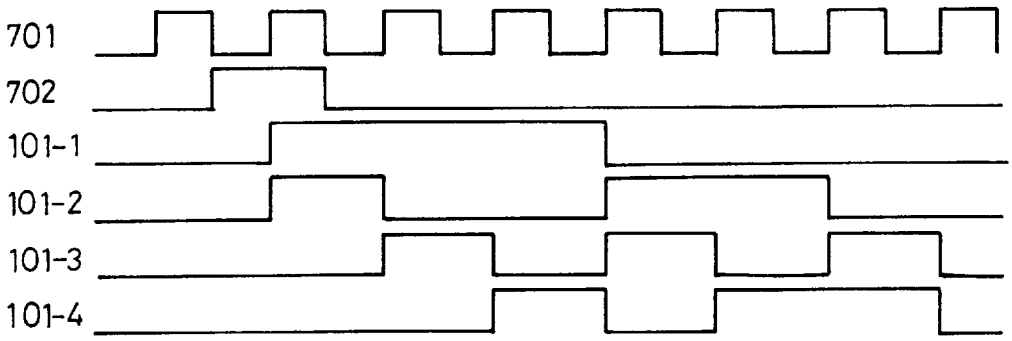
FIG. 21 shows waveforms of input signals and output signals of the encoder of FIG. 20.

In the above-mentioned embodiments, signals are supplied to the m lines of pulse signal lines from an external circuit. However, it is possible to reduce the number of external signal lines by including, for example, an encoder shown in FIG. 20 in the scanning circuit for use in a display device. FIG. 21 shows the timing of a clock signal line 701, a start pulse signal line 702, and pulse signal lines 101-1 to 101-4 in the encoder.

The following description discusses another example of the scanning circuit with reference to FIGS. 22 to 26.

Figure 22:
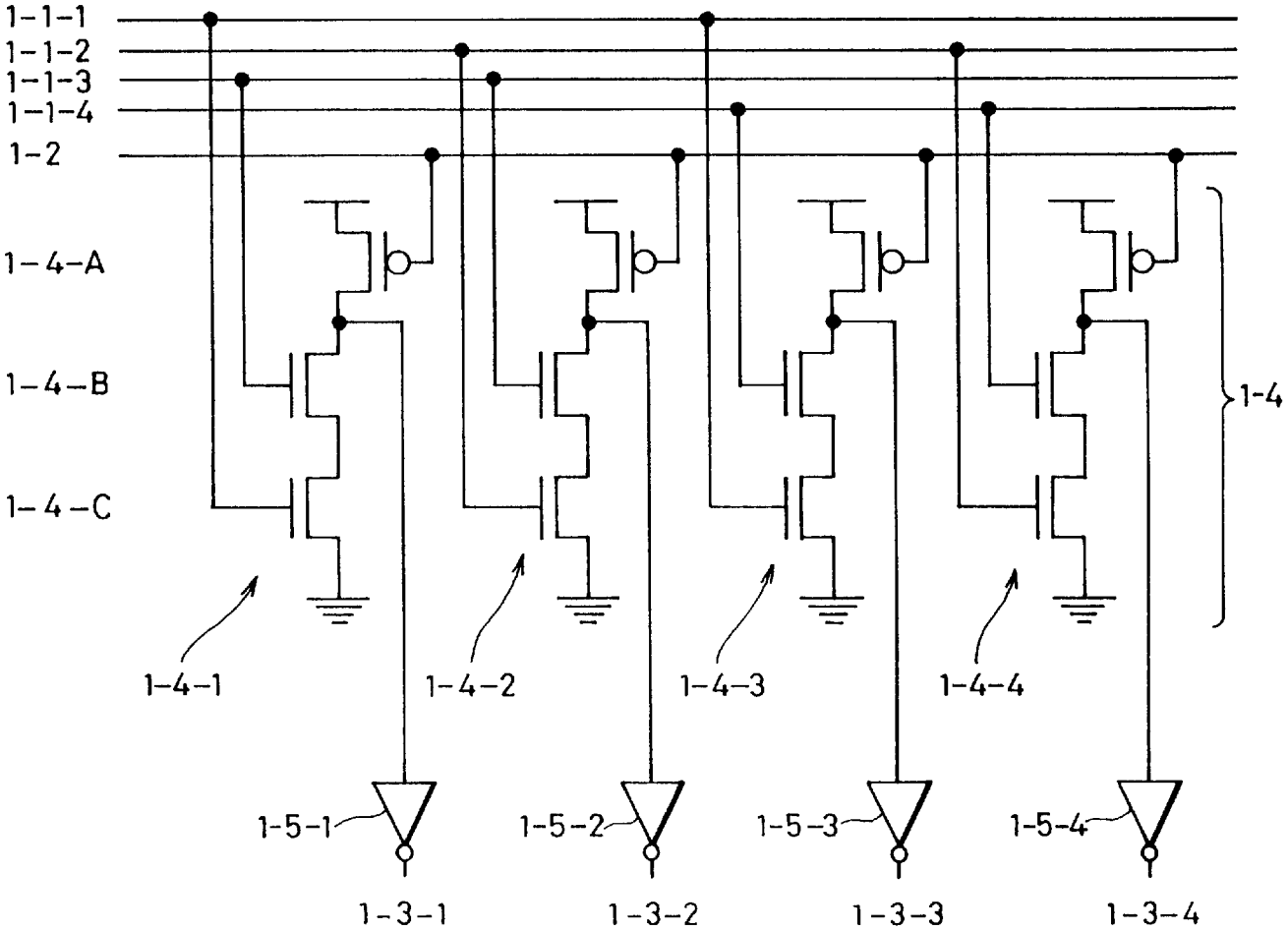
FIG. 22 is a circuit diagram showing another example of the scanning circuit.

As illustrated in FIG. 22, the scanning circuit of this example includes a dynamic decoder 1-4 for decoding pulse signals from pulse signal lines 1-1-1 to 1-1-4, and inverters 1-5-1 to 1-5-4 for inverting the signals from the decoder 1-4 and outputting the inverted signals to output signal lines 1-3-1 to 1-3-4.

The decoders 1-4 includes four decoding sections 1-4-1 to 1-4-4. In each of the decoding sections 1-4-1 to 1-4-4, the drain and the source of a P-type transistor 1-4-A are connected in series to the drains and sources of two N-type transistors 1-4-B and 1-4-C from the power source side to the GND (ground) side.

The gate of the P-type transistor 1-4-A in each of the decoding sections 1-4-1 and 1-4-4 is connected to a reset signal line 1-2.

The gate of the N-type transistor 1-4-C in the decoding section 1-4-1 is connected to the pulse signal line 1-1-1, while the gate of the N-type transistor 1-4-B therein is connected to the pulse signal line 1-1-3.

The gate of the N-type transistor 1-4-C in the decoding section 1-4-2 is connected to the pulse signal line 1-1-2, while the gate of the N-type transistor 1-4-B therein is connected to the pulse signal line 1-1-3.

The gate of the N-type transistor 1-4-C in the decoding section 1-4-3 is connected to the pulse signal line 1-1-1, while the gate of the N-type transistor 1-4-B therein is connected to the pulse signal line 1-1-4.

The gate of the N-type transistor 1-4-C in the decoding section 1-4-4 is connected to the pulse signal line 1-1-2, while the gate of the N-type transistor 1-4-B therein is connected to the pulse signal line 1-1-4.

The outputs (i.e., the junctions between the P-type transistors 1-4-A and the N-type transistors 1-4-B) of the decoding sections 1-4-1 to 1-4-4 are connected to the inputs of the inverters 1-5-1 to 1-5-4, respectively. The outputs of the inverters 1-5-1 to 1-5-4 are connected to the output signal lines 1-3-1 to 1-3-4, respectively.

With this configuration, pulse signals are input to the pulse signal lines 1-1-1 to 1-1-4, while a reset signal is input to the reset signal line 1-2.

Figure 23:
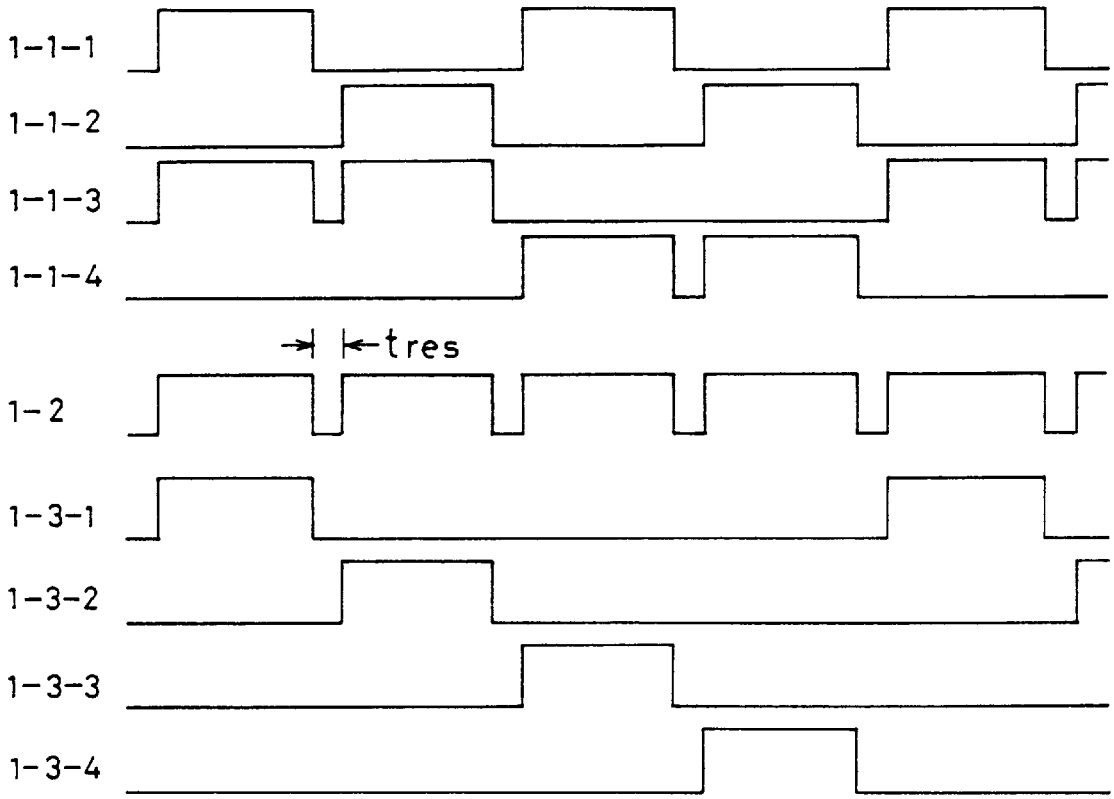
FIG. 23 illustrates waveforms showing an operation of the scanning circuit of FIG. 22.

As illustrated in FIG. 23, the reset signal is arranged to be low level for the predetermined period $T_{res}$ immediately before any of the pulse signal lines 1-1-1 to 1-1-3 becomes high level.

The pulse signals are arranged so that two of the pulse signal lines 1-1-1 to 1-1-4 sequentially become high level during a scanning period and that all the pulse signal lines 1-1-1 to 1-1-4 are reset to the low level during the period $T_{res}$. The pulse signals of the pulse signal lines 1-1-2 to 1-1-4 are the inverted signals of the pulse signals of the pulse signal lines 1-1-1 to 1-1-3. Namely, a half (two) of the four pulse signals lines 1-1-1 to 1-1-4 are independent.

The decoding section 1-4-1 in the decoder 1-4 and the inverter 1-5-1 output the result of the AND of the signals of the pulse signal lines 1-1-1 and 1-1-3 to the output signal lines 1-3-1. The decoding section 1-4-2 in the decoder 1-4 and the inverter 1-5-2 output the result of the AND of the signals of the pulse signal lines 1-1-2 and 1-1-3 to the output signal lines 1-3-2. The decoding section 1-4-3 in the decoder 1-4 and the inverter 1-5-3 output the result of the AND of the signals of the pulse signal lines 1-1-1 and 1-1-4 to the output signal lines 1-3-3. The decoding section 1-4-4 in the decoder 1-4 and the inverter 1-5-4 output the result of the AND of the signals of the pulse signal lines 1-1-2 and 1-1-4 to the output signal lines 1-3-4.

As a result, a scanning signal having pulses which sequentially bring the output signal lines 1-3-1 to 1-3-4 to high level is obtained.

In the predetermined period $T_{res}$ immediately before the pulse signal lines 1-1-1 to 1-1-4 turn into high level, the P-type transistors 1-4-A in all the decoding sections 1-4-1 to 1-4-4 are turned ON by the reset signal and simultaneously the N-type transistors 1-4-B and 1-4-C are turned OFF by the pulse signal. As a result, all the output signal lines 1-3-1 to 1-3-4 become low level. With this structure, it is possible to prevent erroneous operations due to a glitch caused by variations in the characteristics of the elements constituting the scanning circuit and to eliminate variations in the delay time of the scanning pulses. Moreover, since the decoder 1-4 is a dynamic decoder, it is possible to decrease the size and power consumption of the scanning circuit.

Furthermore, four output stages including a decoding sections 1-4-i (i=1, 2, 3, 4) in the decoder 1-4 and inverters 1-5-i are independent of each other, and each of the output stages includes 5 transistors. Therefore, if a non-defect rate of a transistor is represented by P, a probability that each output stage is properly operated is $P^5$. Thus, a probability that the scanning circuit is correctly operated in this example becomes much higher that of a conventional scanning circuit using a shift register.

Here, a scanning circuit used in an image display device according to the HalfVGA (half video graphics array) specifications is taken as one example of the scanning circuit of this example, and the probability that the scanning circuit is correctly operated will be calculated.

In the scanning circuit in the image display device according to the HalfVGA specifications, 18 pulse signal lines and 320 output stages are necessary, and a half (9) of the 18 pulse signal lines are independent.

Each output stage includes one P-type transistor, a decoding section formed by 9 N-type transistors (the number of N-type transistors and that of the independent pulse signal lines being the same), and an inverter. In short, each output stage includes 11 transistors. Thus, the probability that each output stage is correctly operated is $P^{11}$.

Figure 24:
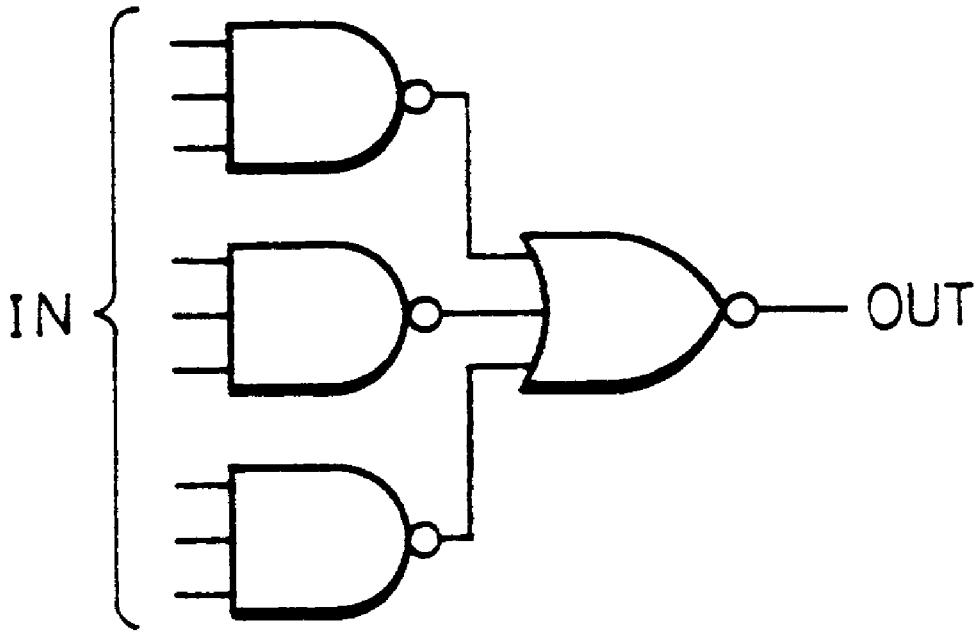
FIG. 24 is a circuit diagrams showing an example of an output stage of the scanning circuit of FIG. 22.

It is also possible to construct each output stage by three dynamic 3-input NAND circuits and one 3-input NOR circuit as illustrated in FIG. 24.

Figure 25:
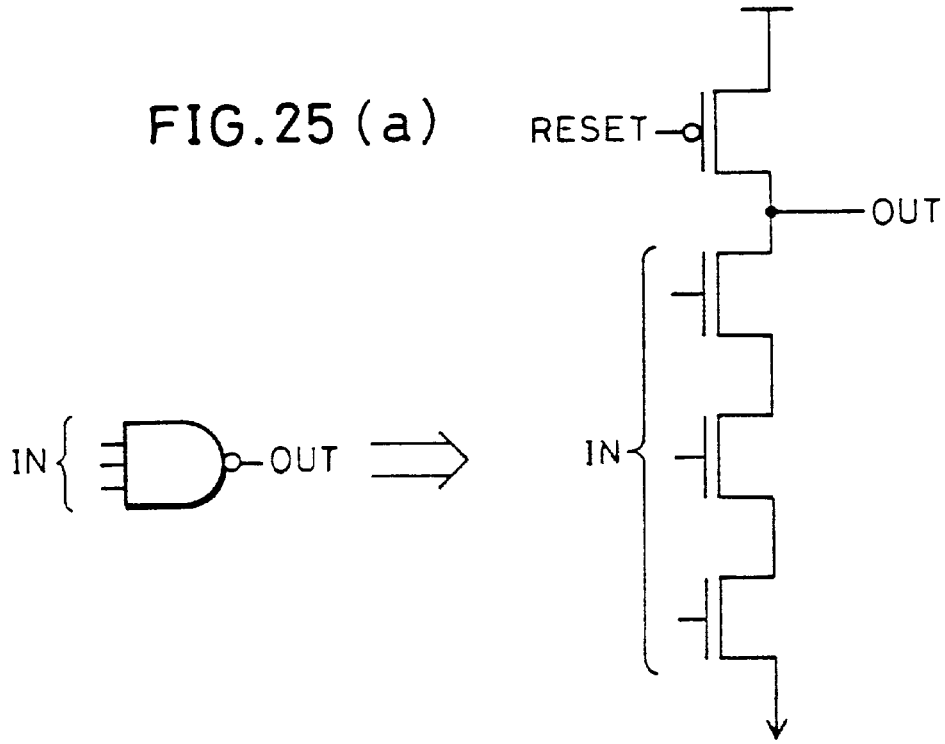
FIG. 25 is a circuit diagram showing an internal structure of a 3-input dynamic NAND circuit shown in FIG. 24.
Figure 25:
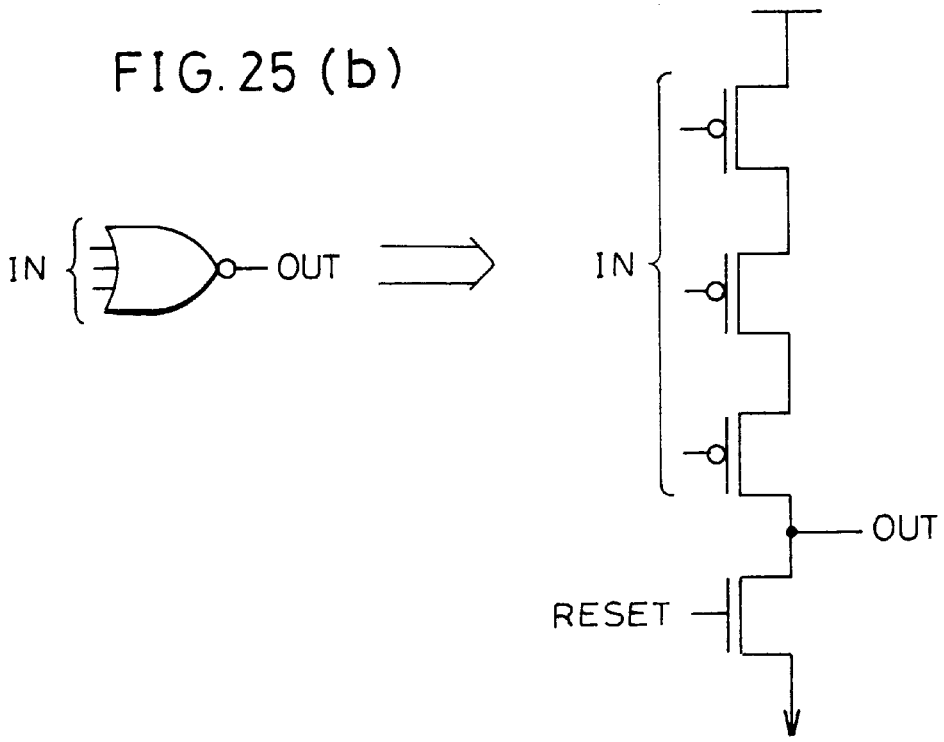

When the dynamic 3-input NAND circuit is used as illustrated in FIG. 25(*a*), an output stage is formed by 18 transistors (12 N-type transistors and 6 P-type transistors). Thus, the probability that each output stage is correctly operated is $P^{18}$.

When the dynamic NAND circuit is used, since the number of the transistors in an output stage becomes larger than that in the above-mentioned output stage, the probability that the output stage is correctly operated becomes lower than that of the above-mentioned scanning circuit. However, since the number of the N-type transistors which are connected in series is reduced to one third, the operation speed is increased.

When the dynamic 3-input NOR circuit is used as illustrated in FIG. 25(*b*), an output stage is formed by 16 transistors (10 N-type transistors and 6 P-type transistors). Thus, the probability that each output stage is correctly operated is $P^{16}$. In this case, it is necessary to invert the polarity of the reset signal between the dynamic NAND circuit and the dynamic NOR circuit.

On the other hand, in the conventional scanning circuit using a shift resister, since the probability of the output in the Lth stage being operable is $P^{10\times(L+1)+6}$, the probability that the first stage is correctly operated and the probability that the 320th stage is correctly operated become $P^{26}$ and $P^{3216}$, respectively.

Since $P^{11} \geqq P^{16} \geqq P^{18} \geqq P^{26} \geqq P^{3216}$, the probability that the scanning circuit of this example is correctly operated becomes much higher than that of the conventional scanning circuit. In addition, the probability that the scanning circuit is correctly operated does not vary depending on the number of output stages. Therefore, even if polysilicon Si thin film transistors which are likely to cause electric characteristic differences and static voltage breakdown are used, a high non-defect rate is ensured.

Furthermore, in the scanning circuit of this example, bidirectional scanning is performed by simply changing pulse signals to be input to the pulse signal lines. Thus, the probability that each output stage is correctly operated in bidirectional scanning is equal to the probability that each output stage is correctly operated in unidirectional scanning. Hence, even if the scanning circuit of this example is employed in an image display device such as a 3-panel projector requiring bidirectional scanning, it is possible to achieve a high non-defect rate similar to that of the image display device performing unidirectional scanning.

On the other hand, in the conventional bidirectional scanning circuit, since the probability that the output in the Lth stage is operable is $P^{16\times(L+1)+6}$, the probability that the first stage is correctly operated is $P^{38}$ and the probability that the 320th stage is correctly operated is $P^{5142}$. Thus, the probability that the output stages are correctly operated in bidirectional scanning becomes smaller than the probability that the output stages are correctly operated in unidirectional scanning.

Namely, in bidirectional scanning, the probability that the scanning circuit of this example is correctly operated becomes much higher than the probability that the conventional scanning circuit is correctly operated.

Figure 26:
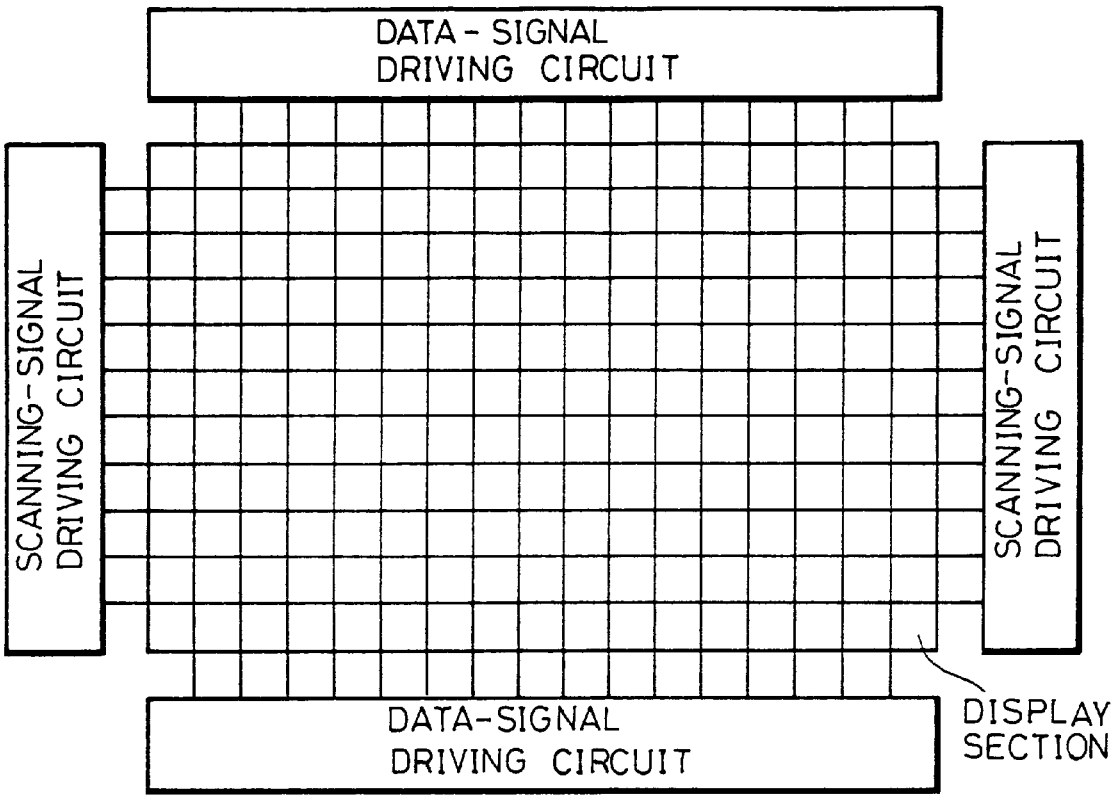
FIG. 26 is a block diagram showing a schematic structure of an active-matrix image display device.

When the scanning circuit of this example is used for the data-signal-line driving circuits and the scanning-signal-line driving circuits in the active-matrix image display device shown in FIG. 26, i.e., when it is used for a pair of uniform data-signal-line driving circuits disposed on the upper and lower sides of a display section and for a pair of uniform scanning-signal-line driving circuits located on right and left sides of the display section, even if one of the pair of the driving circuits has trouble, it is possible to display correct images by the other pair of driving circuits. Moreover, even when an output stage in the other pair of the driving circuits has a defect, lines which are not correspond to the defective line do not suffer from the effects.

On the other hand, when the conventional scanning circuit using a shift register is used for the driving circuits, if a defect occurs in an output stage of the remaining driving circuit, is becomes impossible to display all the lines after the line corresponding to the defective stage.

Furthermore, as described above, with the scanning circuit of this example, it is possible to output scanning signals of images of different standards (for example, images which meet the HDTV standards and images which meet the XGA standard) by simply changing the pulse signals. In short, it is possible to display images of different standards by simply changing the pulse signals. Hence, the scanning circuit of this example does not require a selector which is essential for the conventional scanning circuit in order to display images of different standards.

In addition, in the scanning circuit of this example, since each of the output stages is independent, it does not suffer from the effect caused by a delay of a signal from the previous output stage and the effect caused by the load of the succeeding stage. Thus, in the scanning circuit of this example, operations are performed at higher speeds in comparison with the conventional scanning circuit using a shift register which suffers from these effects. It is therefore possible to apply the present invention to the structure in which the display panel and the driving circuits are integrated using polycrystal Si thin film transistors. Consequently, the structure of the scanning circuit is simplified and the area occupied by the scanning circuit is decreased compared with the conventional scanning circuit which requires a plurality of shift registers. It is therefore possible to provide a more compact and less expensive image display device.

In the above-mentioned examples, in order to obtain a scanning signal having pulses which sequentially turns the L lines of output signal lines into high level, m independent pulse signals which satisfy the condition, $L \leqq 2^m$, need to be input. Here, m is the number of the independent pulse signals, and calculated by counting a pulse signal and its inverted pulse signal as one signal. The scanning circuit includes one decoder having L decoding sections, and L inverters. Each decoding section is formed by connecting one transistor and m transistors of opposite polarity in series.

Another example of the scanning circuit is explained below with reference to FIGS. 27 and 28. The members having the same function as in the above-mentioned examples will be designated by the same code and their description will be omitted.

Figure 27:
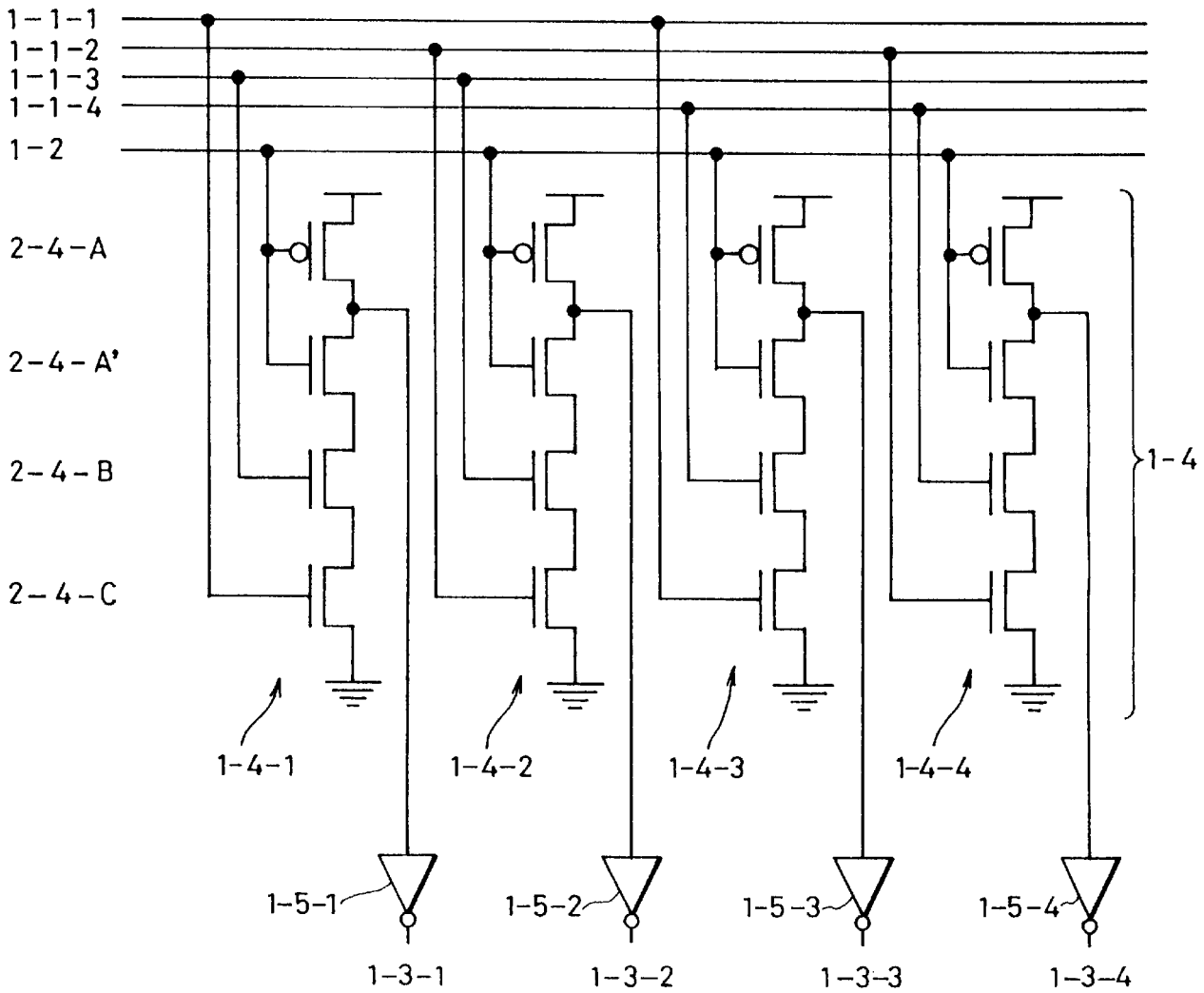
FIG. 27 is a circuit diagram showing another example of the scanning circuit.

As illustrated in FIG. 27, the structures of the decoding sections 1-4-1 to 1-4-4 of the decoder 1-4 in the scanning circuit of this example differ from those of the above-mentioned scanning circuit.

In each of the decoding sections 1-4-1 to 1-4-4, the drain and the source of a P-type transistor 2-4-A are connected in series to the drains and sources of three N-type transistors 2-4-A' to 2-4-C from the power source side to the GND side.

The gate of the P-type transistor 2-4-A and the gate of the N-type transistor 2-4-A' in each of the decoding sections 2-4-1 and 2-4-4 are connected to the reset signal line 1-2.

The outputs (i.e., the junctions between the P-type transistors 2-4-A and the N-type transistors 2-4-A') of the decoding sections 2-4-1 to 2-4-4 are connected to the inputs of the inverters 1-5-1 to 1-5-4, respectively. The outputs of the inverters 1-5-1 to 1-5-4 are connected to the output signal lines 1-3-1 to 1-3-4, respectively.

Except for those mentioned above, all the connections are made in the manner described in the above-mentioned example.

With this configuration, pulse signals are input to the pulse signal lines 1-1-1 to 1-1-4, while a reset signal is input to the reset signal line 1-2. As a result, a scanning signal having pulses which sequentially turn the output signal lines 1-3-1 to 1-3-4 into high level is obtained.

Figure 28:
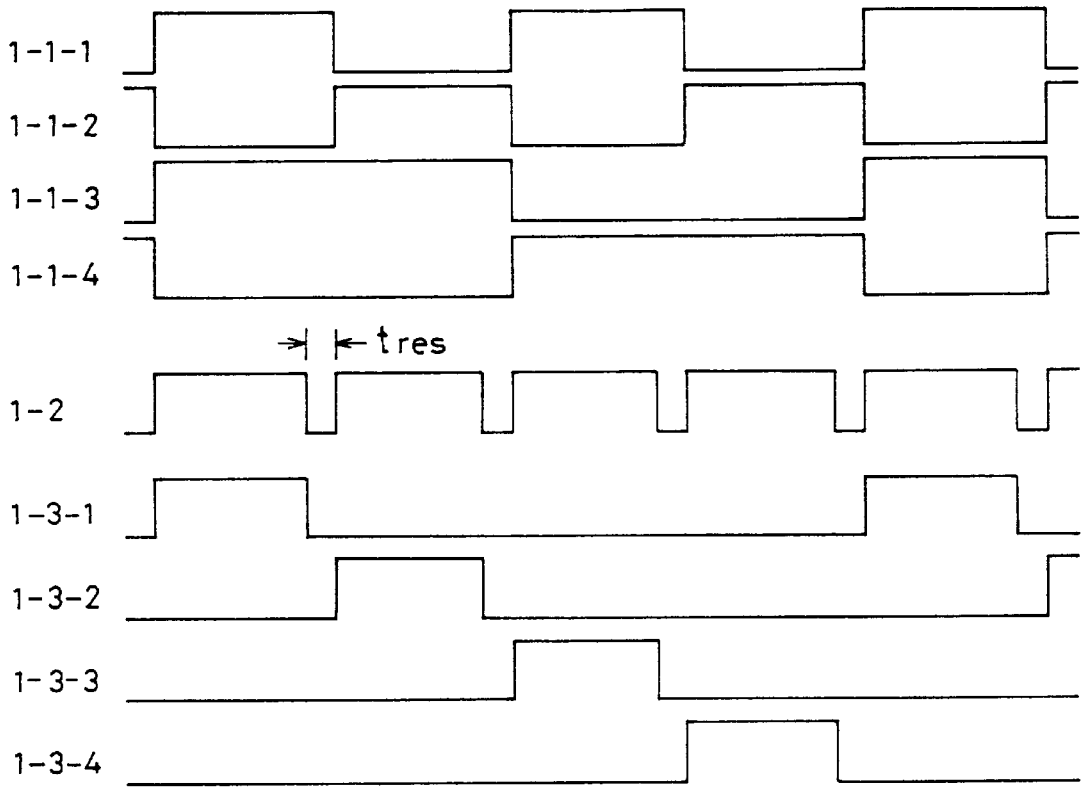
FIG. 28 illustrates waveforms showing an operation of the scanning circuit of FIG. 27.

As illustrated in FIG. 28, in the scanning circuit of this example, there is no need to reset the pulse signals in synchronism with the reset signal. Thus, the scanning signal is obtained by simply inputting pulse signals of simple waveforms.

When the scanning circuit of this example is applied to a scanning circuit in an image display device according to the HalfVGA specifications, the probability that the scanning circuit is correctly operated becomes $P^{20}$. Similarly to the above-mentioned example, the probability that the scanning circuit of this example is correctly operated becomes much higher than that of the conventional scanning circuit. In addition, the probability that the scanning circuit is correctly operated does not depend on the number of output stages. Therefore, even if polysilicon Si thin film transistors which are likely to cause electric characteristic differences and static voltage breakdown are used for the scanning circuit, a high non-defect rate is ensured.

Another example of the scanning circuit is explained below with reference to FIGS. 29 and 30. The members having the same function as in the above-mentioned examples will be designated by the same code and their description will be omitted.

The scanning circuit of this example has the same structure as the scanning circuit of the above-mentioned example except those mentioned below. As illustrated in FIG. 29, the pulse signal lines 1-1-2 and 1-1-4 are not included, the gates of the transistors which are connected to the pulse signal lines 1-1-2 and 1-1-4 in the above-mentioned example are connected to the pulse signal lines 1-1-1 and 1-1-3, and the N-type transistors are used instead of the P-type transistors.

With this structure, pulse signals are input to the pulse signal lines 1-1-1 and 1-1-3, while the reset signal is input to the reset signal line 1-2. As a result, a scanning signal having pulses which sequentially turn the output signal lines 1-3-1 to 1-3-4 into high level is obtained.

Figure 30:
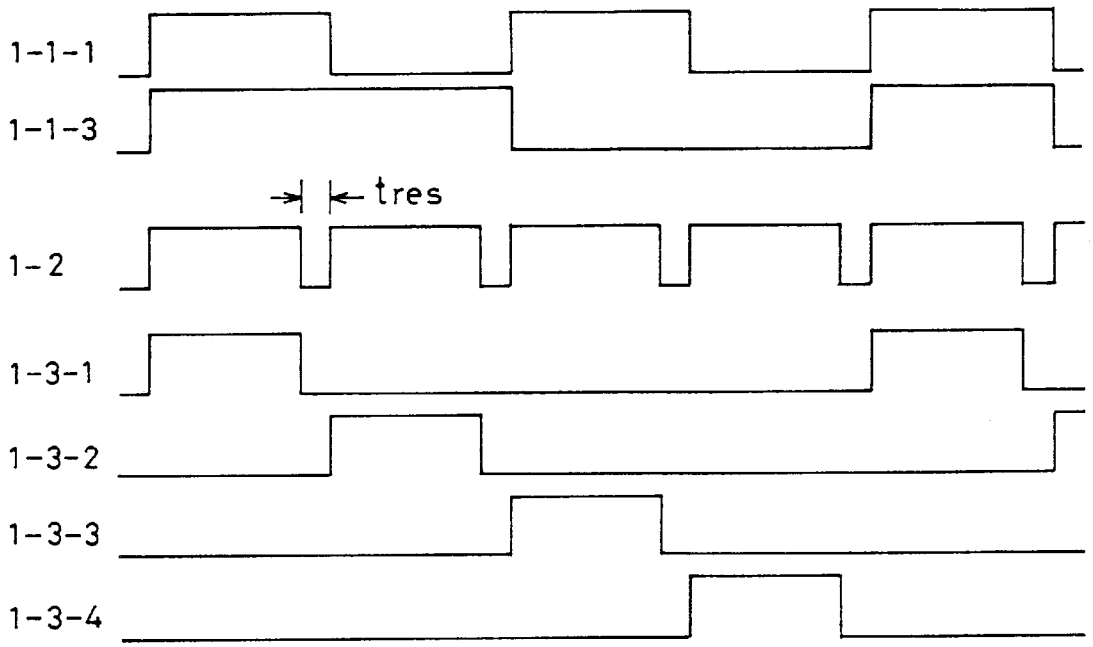
FIG. 30 illustrates waveforms showing an operation of the scanning circuit of FIG. 29.

Like the above-mentioned example, as illustrated in FIG. 30, with the scanning circuit of this example, there is no need to reset the pulse signals in synchronism with the reset signal. It is thus possible to obtain the scanning signal by simply inputting pulse signals of simple waveforms. Additionally, since the number of the pulse signal lines is reduced to a half (1-1-1 and 1-1-3) of the number of the pulse signal lines (1-1-1 to 1-1-4) used in the above-mentioned example, the scanning circuit is decreased in size.

Furthermore, in the scanning circuit of this example, since the P-type transistor is used for the input section of the pulse signal, the potential between the gate and the source becomes substantially zero when the transistor is turned ON, resulting in a longer decay time. In order to avoid this, it is necessary to set the potential to be input to the gate to a value which is lower than the source potential by at least the threshold value of the P-type transistor. With this arrangement, since the decay time is shortened, the operations are carried out at higher speeds.

The number of transistors necessary for the scanning circuit of this example is the same as that in the above-mentioned example. Accordingly, the probability that the scanning circuit of this example is correctly operated is the same as that in the above-mentioned example.

Figure 31:
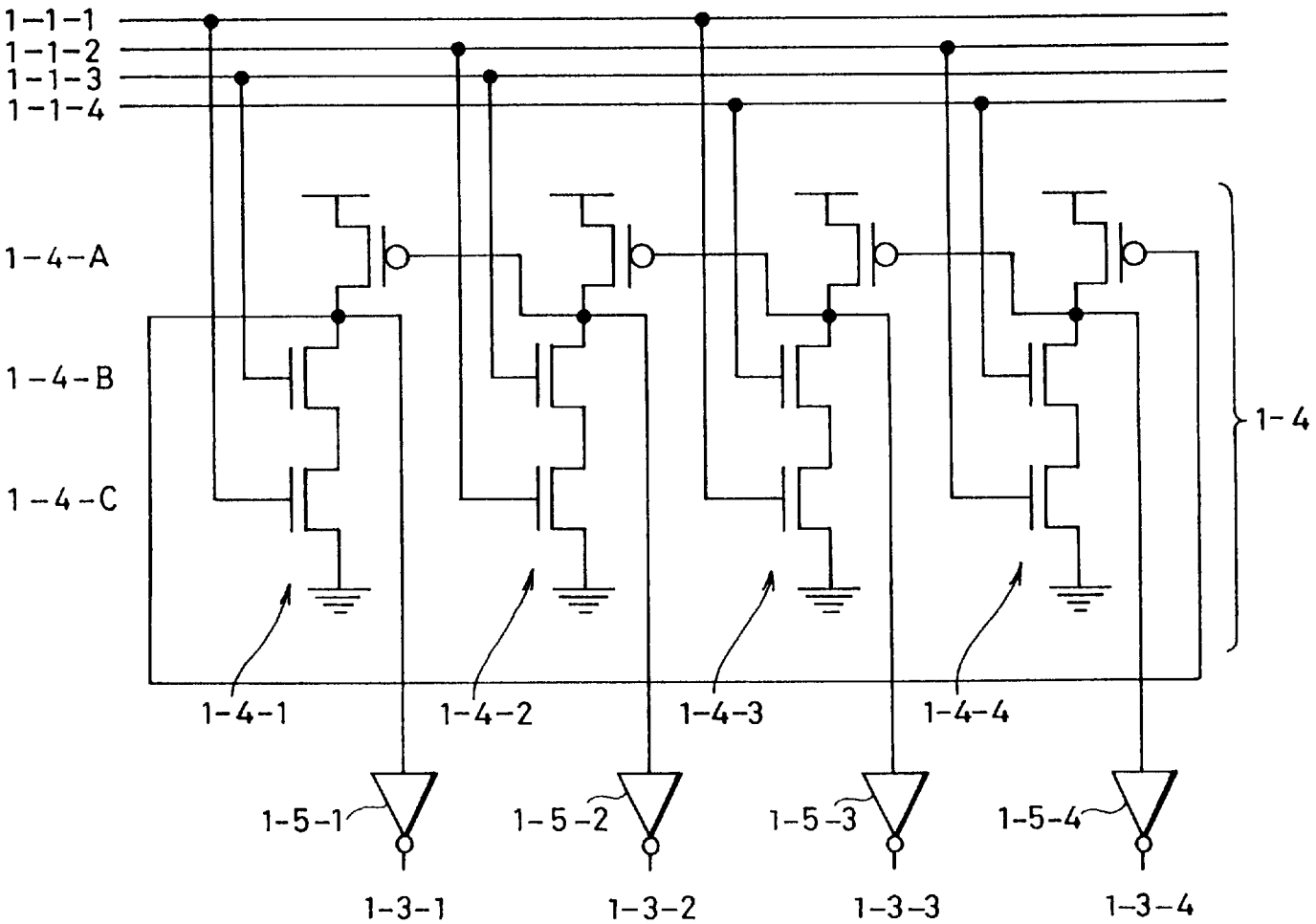
FIG. 31 is a circuit diagram showing yet another example of the scanning circuit.
Figure 32:
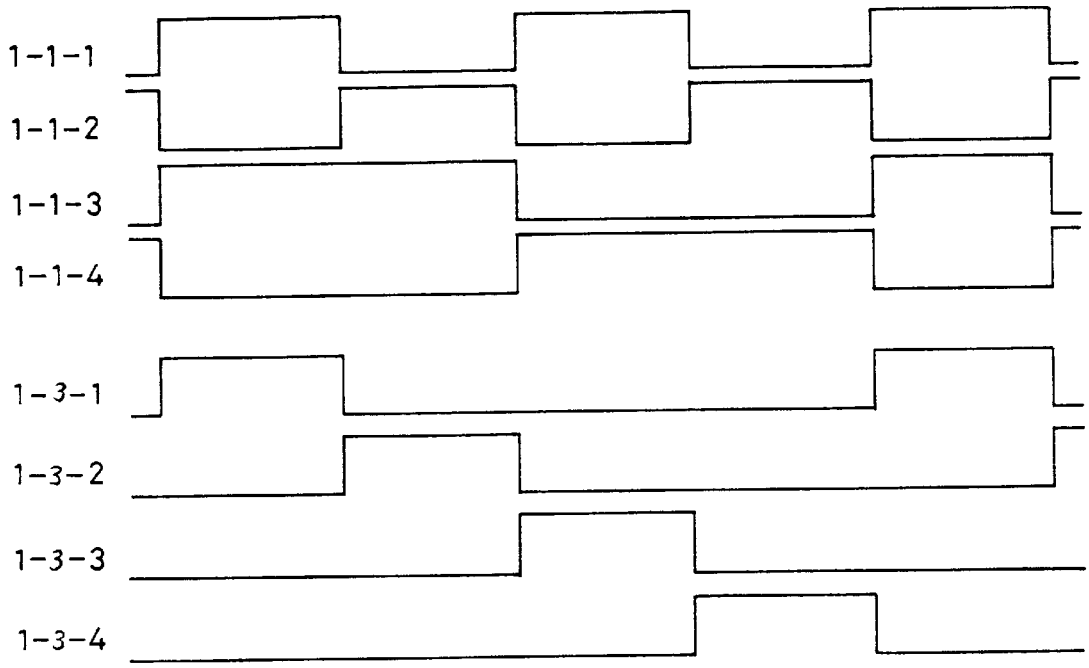
FIG. 32 illustrates waveforms showing an operation of the scanning circuit of FIG. 31.

Another example of the scanning circuit is explained below with reference to FIGS. 31 and 32. The members having the same function as in the above-mentioned example will be designated by the same code and their description will be omitted.

The scanning circuit of this example has the same structure as the scanning circuit of the above-mentioned example shown in FIG. 22 except those mentioned below. As illustrated in FIG. 31, the reset signal lines 1-2 is not included, and the gates of the P-type transistors 1-4-A in the decoding sections 1-4-1, 1-4-2, 1-4-3 and 1-4-4 which are connected to the reset signal line 1-2 in the above-mentioned example are connected to the outputs (i.e., the junctions between the P-type transistors 1-4-A and the N-type transistors 1-4-B) of the decoding sections 1-4-2, 1-4-3, 1-4-4 and 1-4-1, respectively.

With this structure, pulse signals are input to the pulse signal lines 1-1-1 to 1-1-4. When the output signal line 1-3-i becomes high level, the P-type transistor 1-4-A in a decoding section 1-4-(i−1) is turned ON. Then, similarly to the above-mentioned example, a scanning signal including pulses which sequentially turn the output signal lines 1-3-1 to 1-3-4 into high level is obtained as shown in FIG. 32. The scanning circuit of this example is designed exclusively for unidirectional scanning.

With the scanning circuit of this example, the reset signal line 1-2 in the above-mentioned example is not necessary, thereby achieving a simplified and more compact circuit.

The number of transistors necessary for the scanning circuit of this example is the same as that in the above-mentioned example shown in FIG. 22. Accordingly, the probability that the scanning circuit of this example is correctly operated is the same as that in the above-mentioned example.

Figure 33:
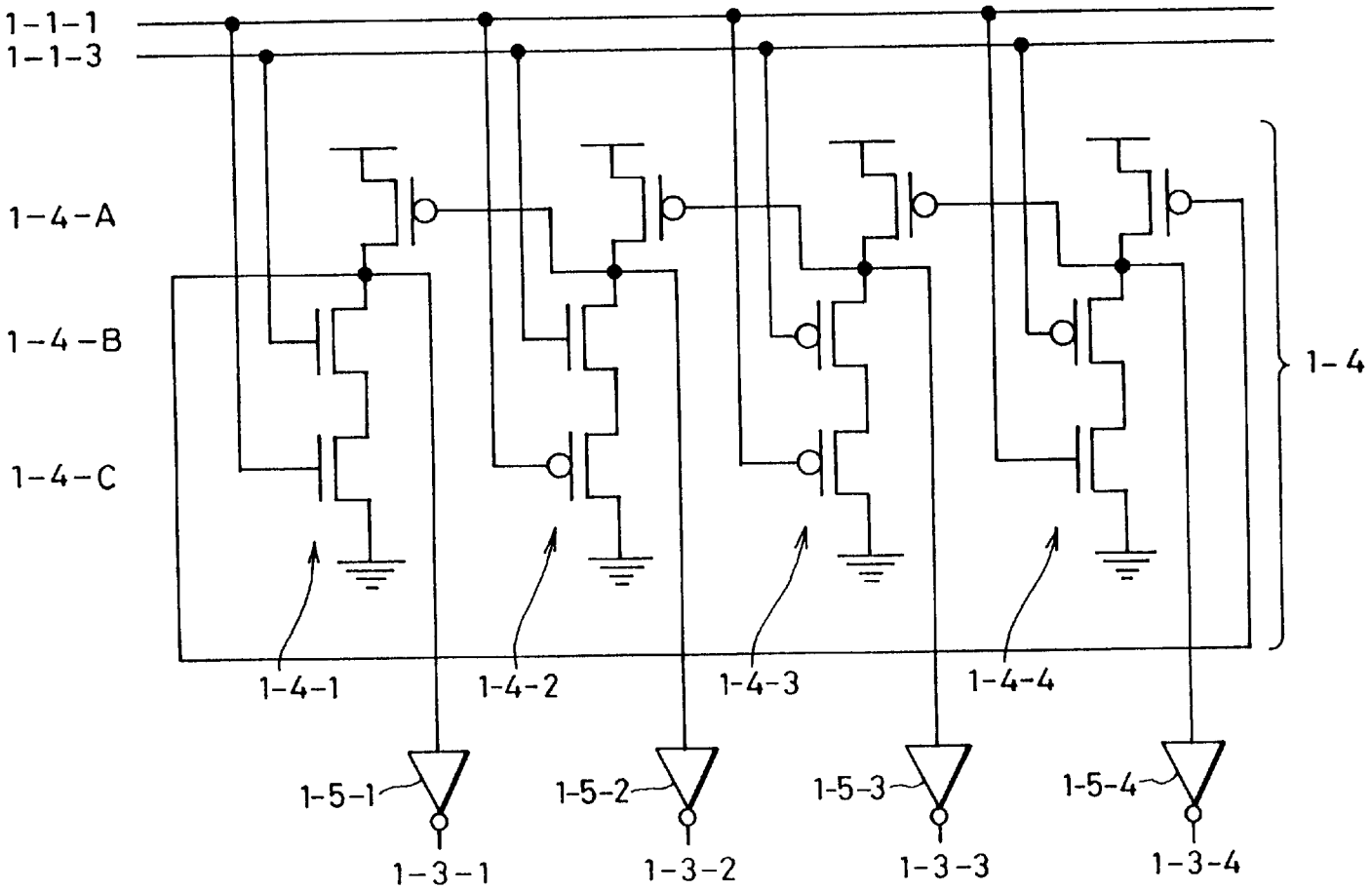
FIG. 33 is a circuit diagram showing another example of the scanning circuit.
Figure 34:
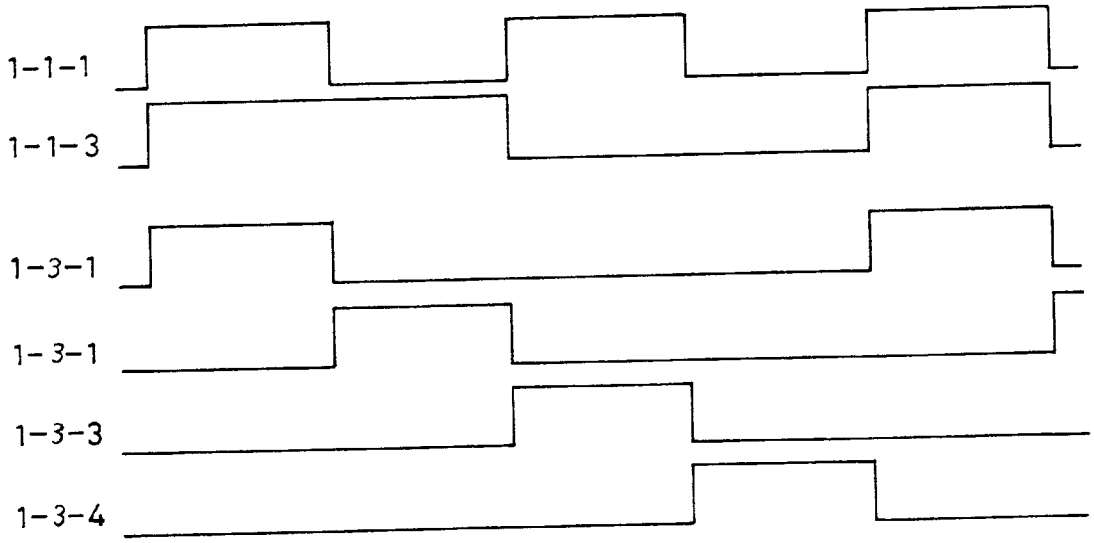
FIG. 34 illustrates waveforms showing an operation of the scanning circuit of FIG. 33.

Another example of the scanning circuit is explained below with reference to FIGS. 33 and 34. The members having the same function as in the above-mentioned example will be designated by the same code and their description will be omitted.

The scanning circuit of this example has the same structure as the scanning circuit of the above-mentioned example except those mentioned below. As illustrated in FIG. 33, the pulse signal lines 1-1-2 and 1-1-4 are not included, the gates of the transistors which are connected to the pulse signal lines 1-1-2 and 1-1-4 in the above-mentioned example are connected to the pulse signal lines 1-1-1 and 1-1-3, and the P-type transistors are used instead of the N-type transistors.

With this structure, pulse signals are input to the pulse signal lines 1-1-1 and 1-1-3. As a result, similarly to the above-mentioned embodiment, a scanning signal having pulses which sequentially turn the output signal lines 1-3-1 to 1-3-4 into high level is obtained as shown in FIG. 34.

With the scanning circuit of this example, the pulse signal lines 1-1-2 and 1-1-4 in the above-mentioned example are not necessary, thereby achieving a simplified and more compact circuit. The scanning circuit of this example is exclusively used for unidirectional scanning.

The number of transistors necessary for the scanning circuit of this example is the same as that in the above-mentioned example. Accordingly, the probability that the scanning circuit of this example is correctly operated is the same as that in the above-mentioned example.

Figure 29:
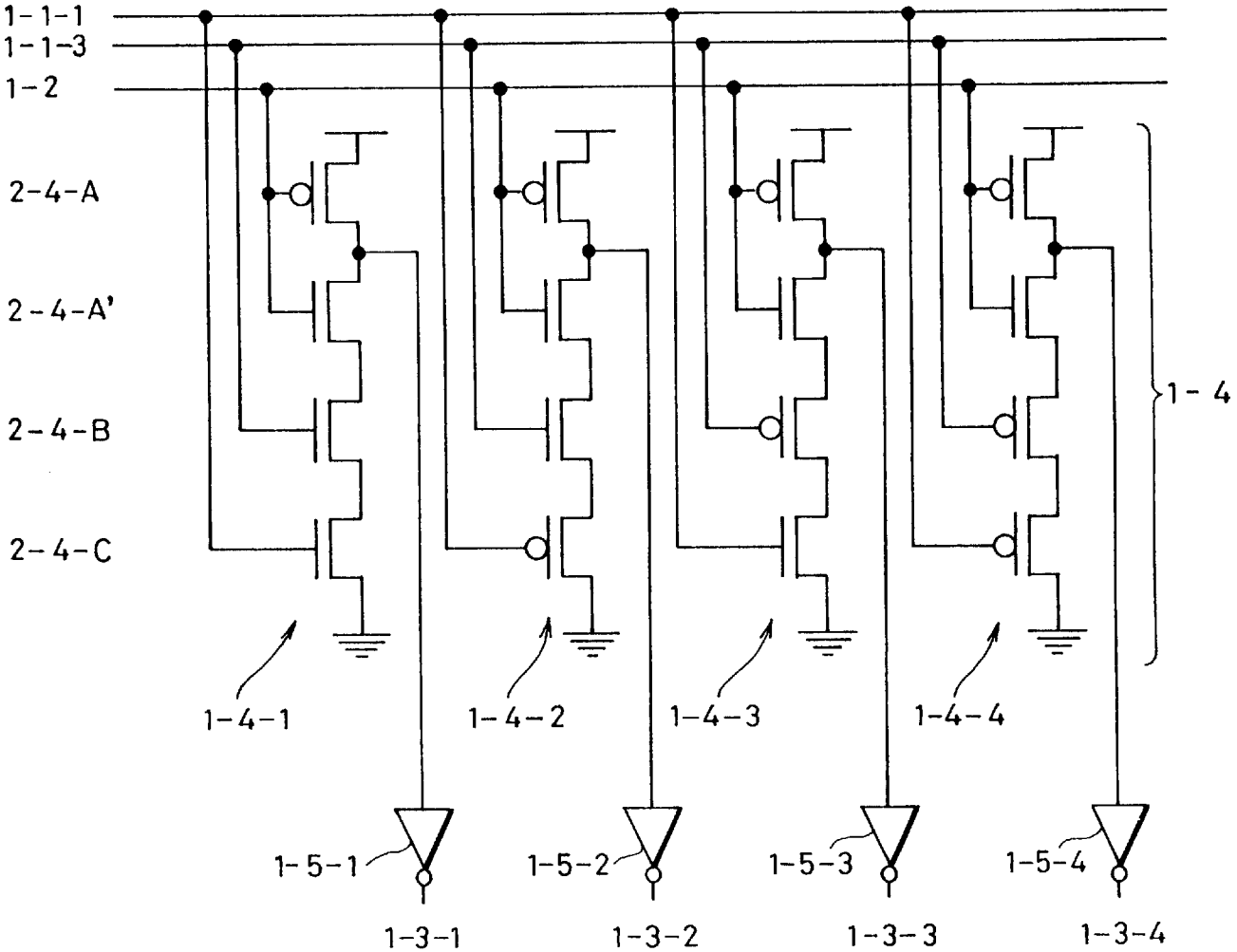
FIG. 29 is a circuit diagram showing still another example of the scanning circuit.

In the scanning circuits of FIGS. 22, 27 and 29, after receiving the reset signal, the decoding section 1-4-i of the decoder 1-4 which does not transmit a low-level output enters into a high-impedance state. In the scanning circuits show in FIGS. 31 and 33, after receiving the reset signal, the decoding section 1-4-i is in the high-impedance state until the next pulse signal is input after the completion of one scanning cycle.

Figure 35A:
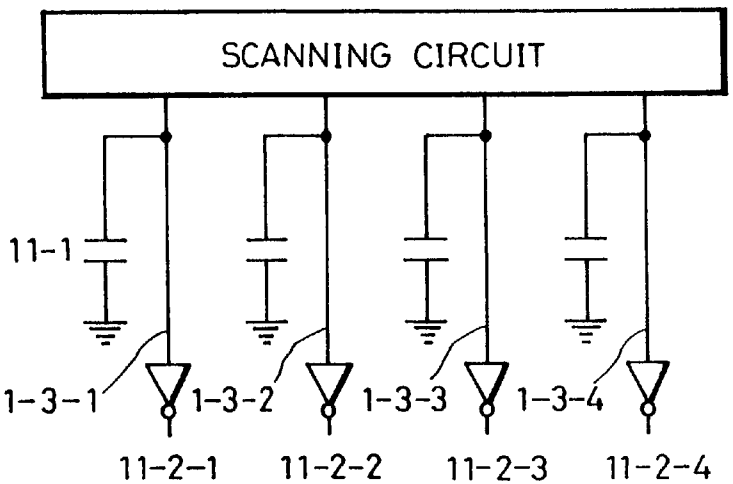
FIG. 35(*a*) is a circuit diagram showing a structure for retaining a voltage of an output signal line of a scanning circuit.
Figure 35B:
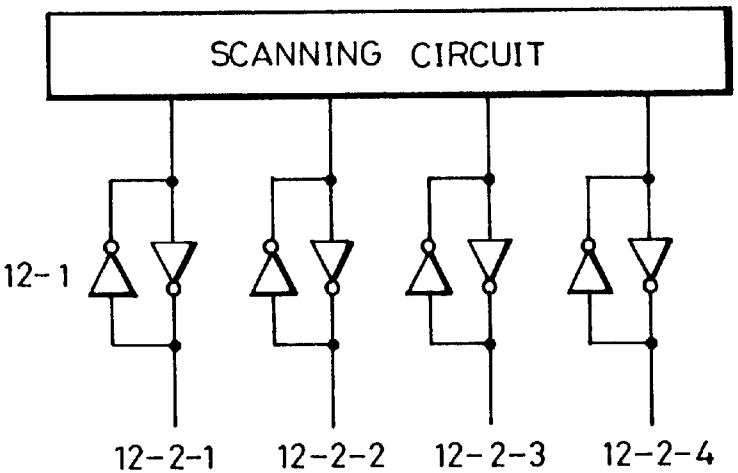
Figure 36:
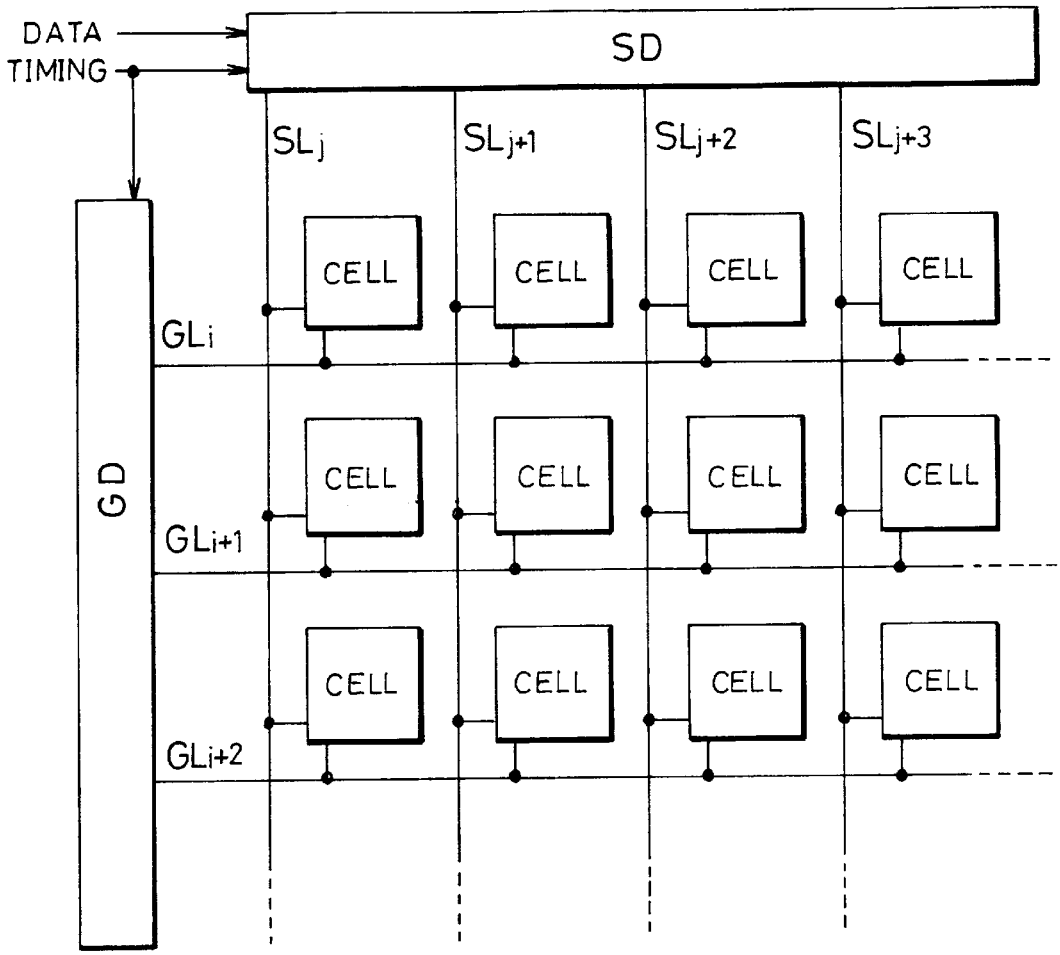
FIG. 36 is a block diagram showing an example of a conventional image display device.
Figure 37:
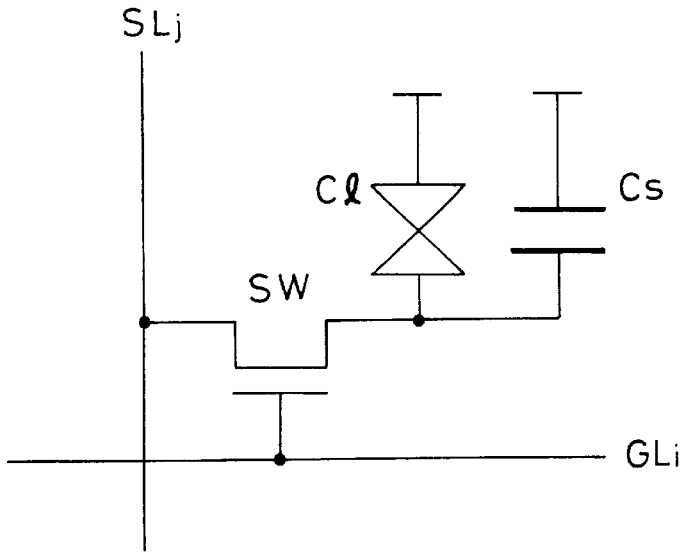
FIG. 37 is a circuit diagram showing a structure of a pixel in a liquid crystal display device as the image display device of FIG. 36.
Figure 38:
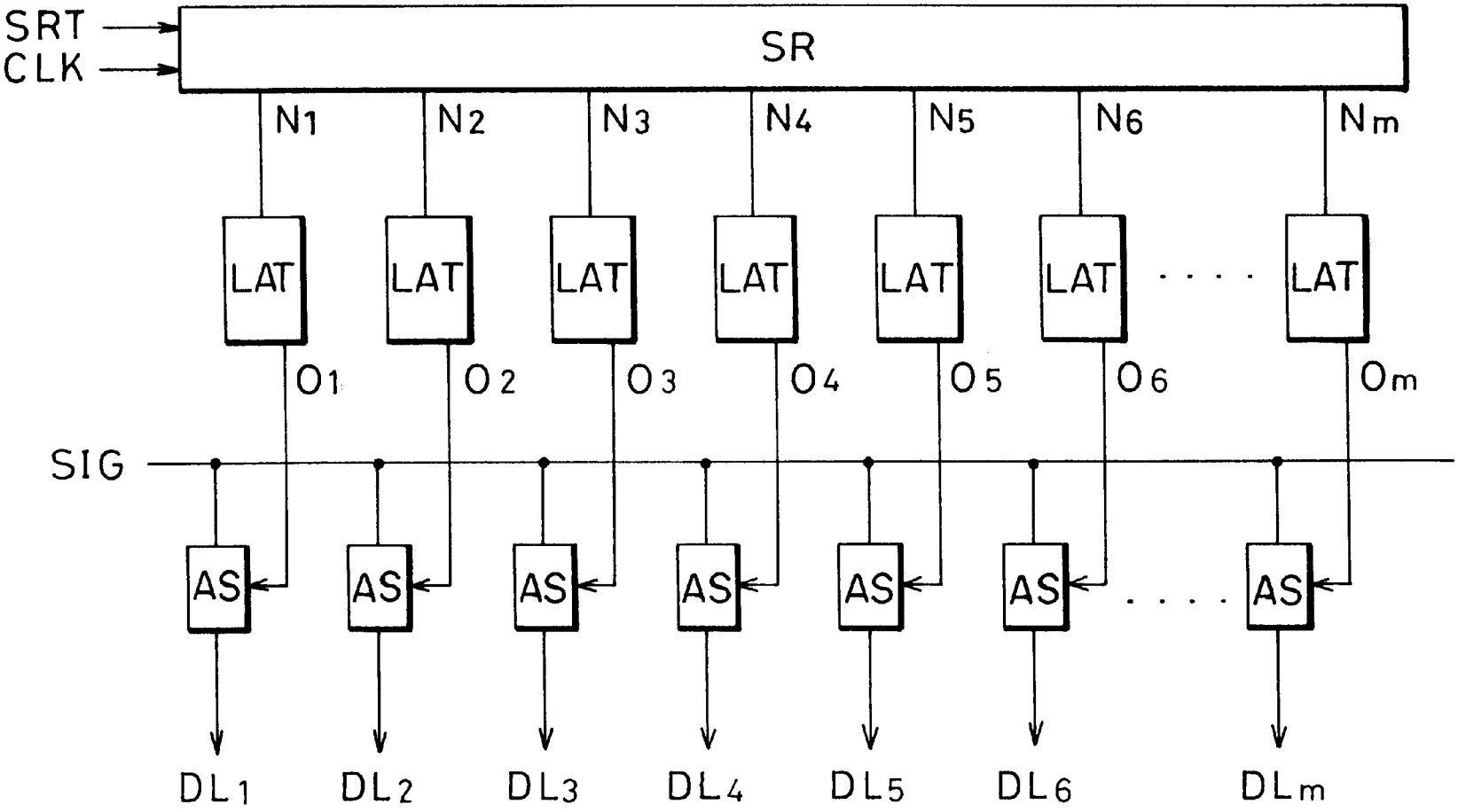
FIG. 38 is a block diagram showing an example of the structure of a data-signal-line driving circuit using a dot sequential driving method in the image display device of FIG. 36.
Figure 39:
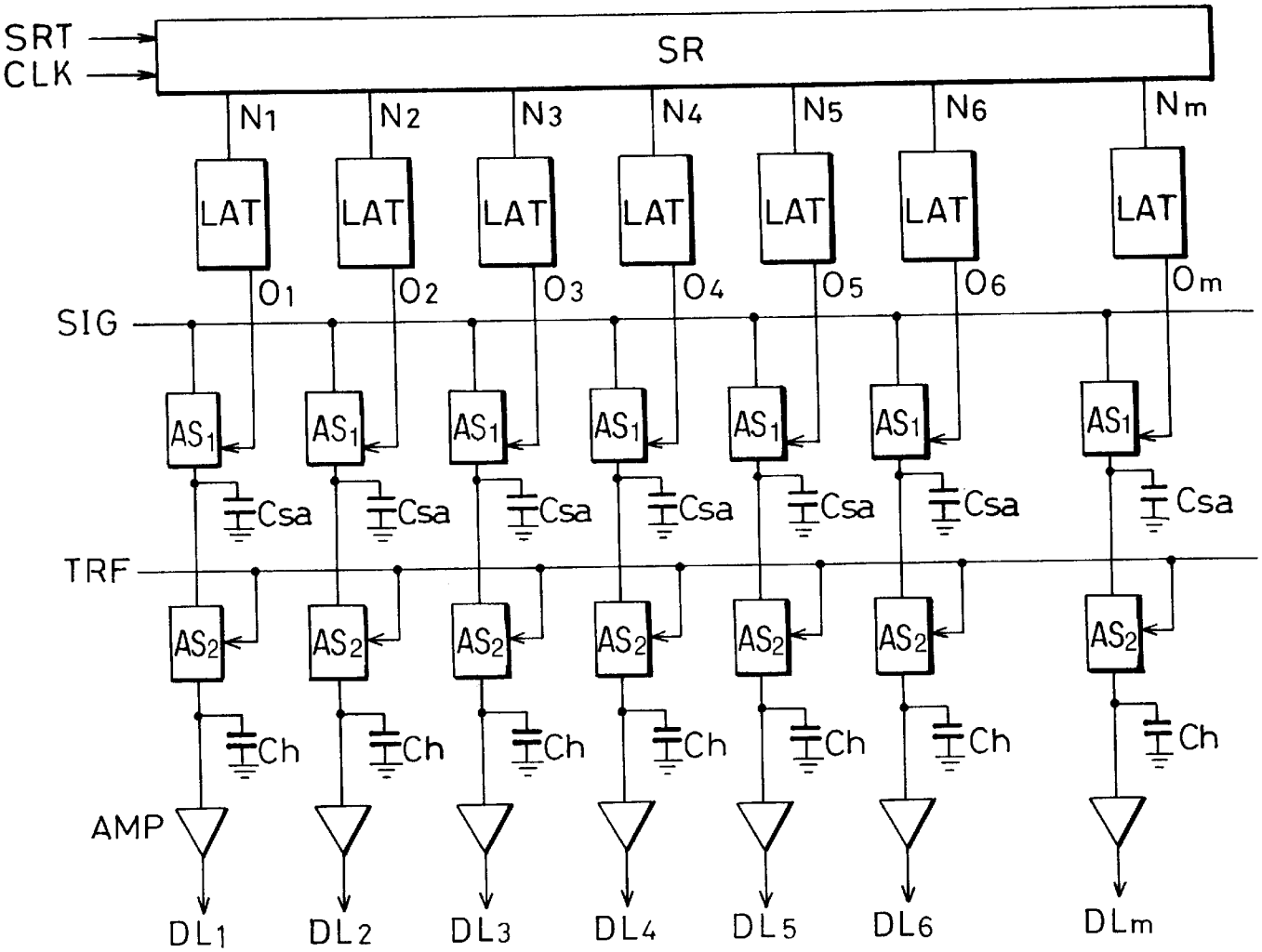
FIG. 39 is a block diagram showing an example of the structure of a data-signal-line driving circuit using a line sequential driving method in the image display device of FIG. 36.
Figure 40:
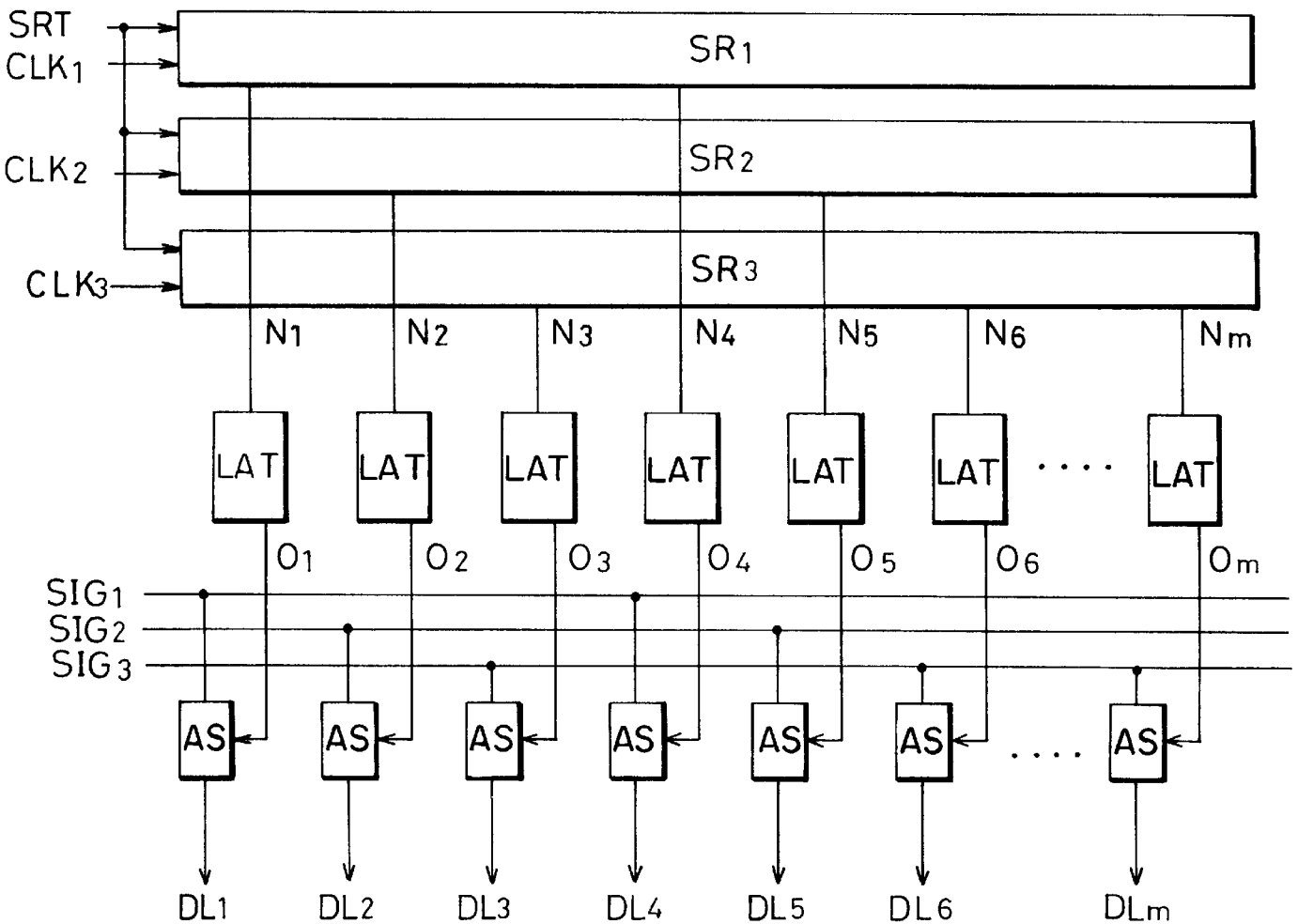
FIG. 40 is a block diagram showing an example of the structure of a data-signal-line driving circuit using a plurality of shift registers in the image display device of FIG. 36.
Figure 41:
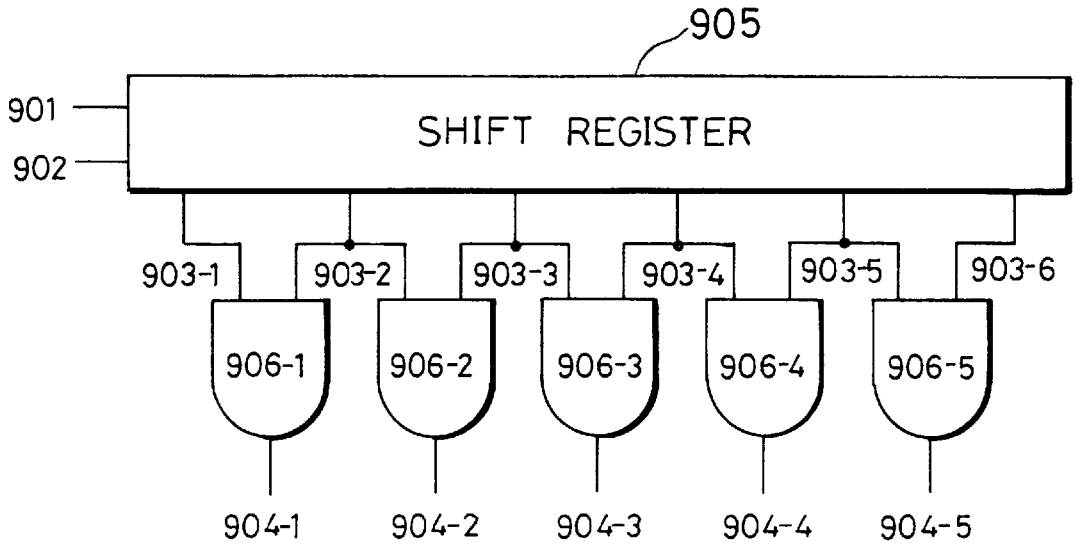
FIG. 41 is a block diagram showing an example of a conventional scanning circuit for use in a display device.
Figure 42:
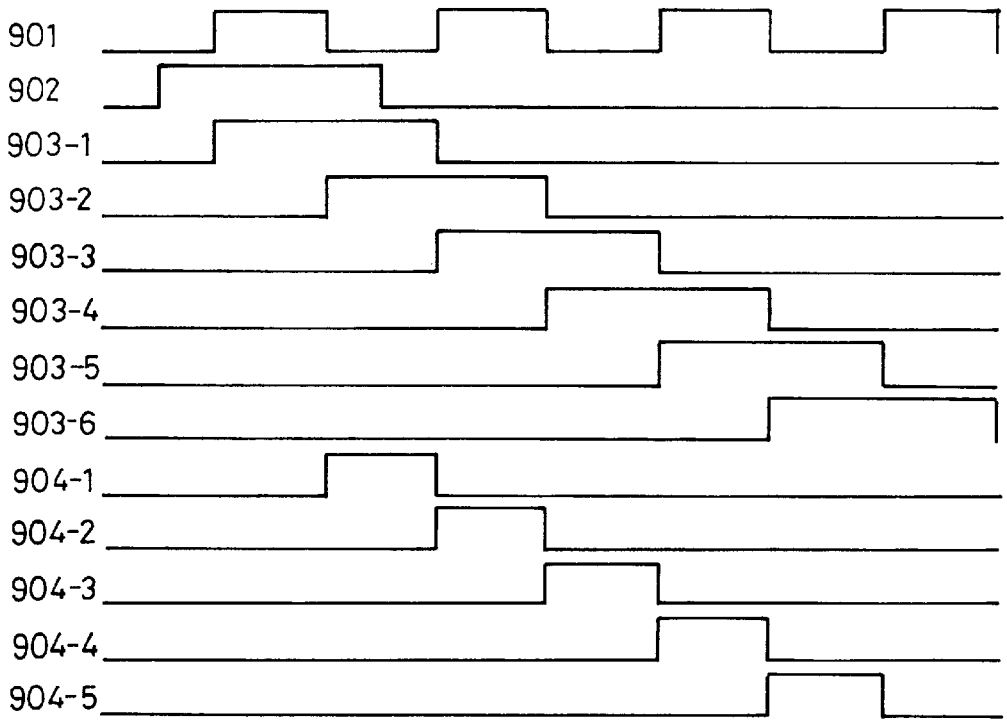
FIG. 42 illustrates waveforms of input signals and output signals of the scanning circuit of FIG. 41.
Figure 43:
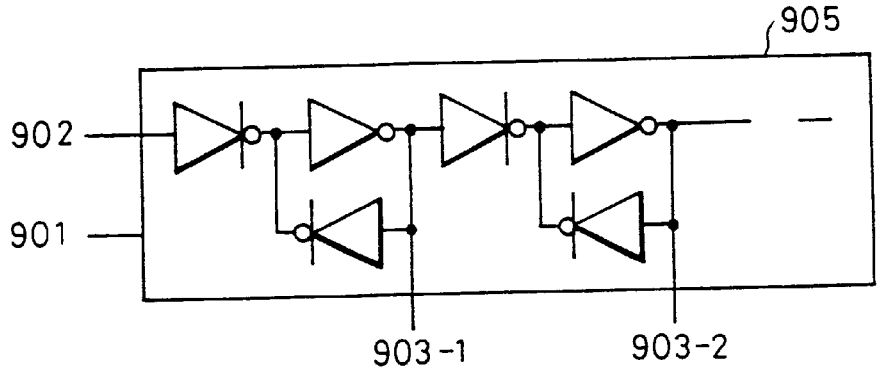
FIG. 43 is a circuit diagram showing a structure of a shift register in the scanning circuit of FIG. 41.
Figure 44:
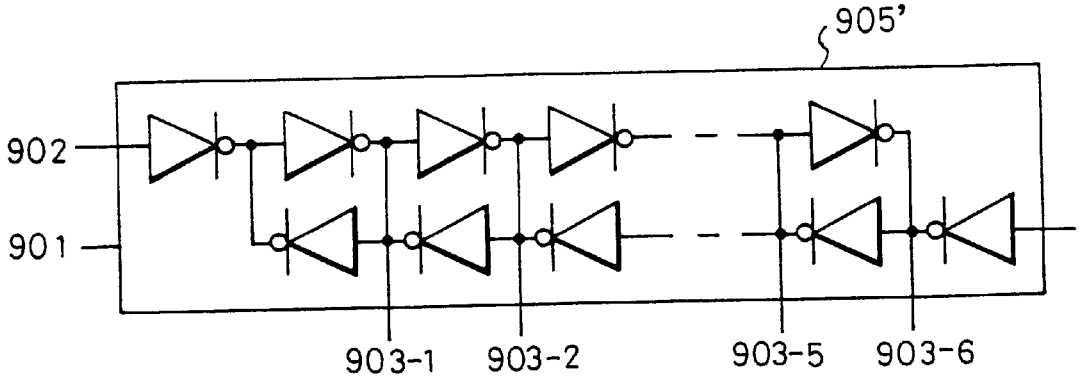
FIG. 44 is a circuit diagram showing the structure of a shift register capable of producing bidirectional shifts.
Figure 45:
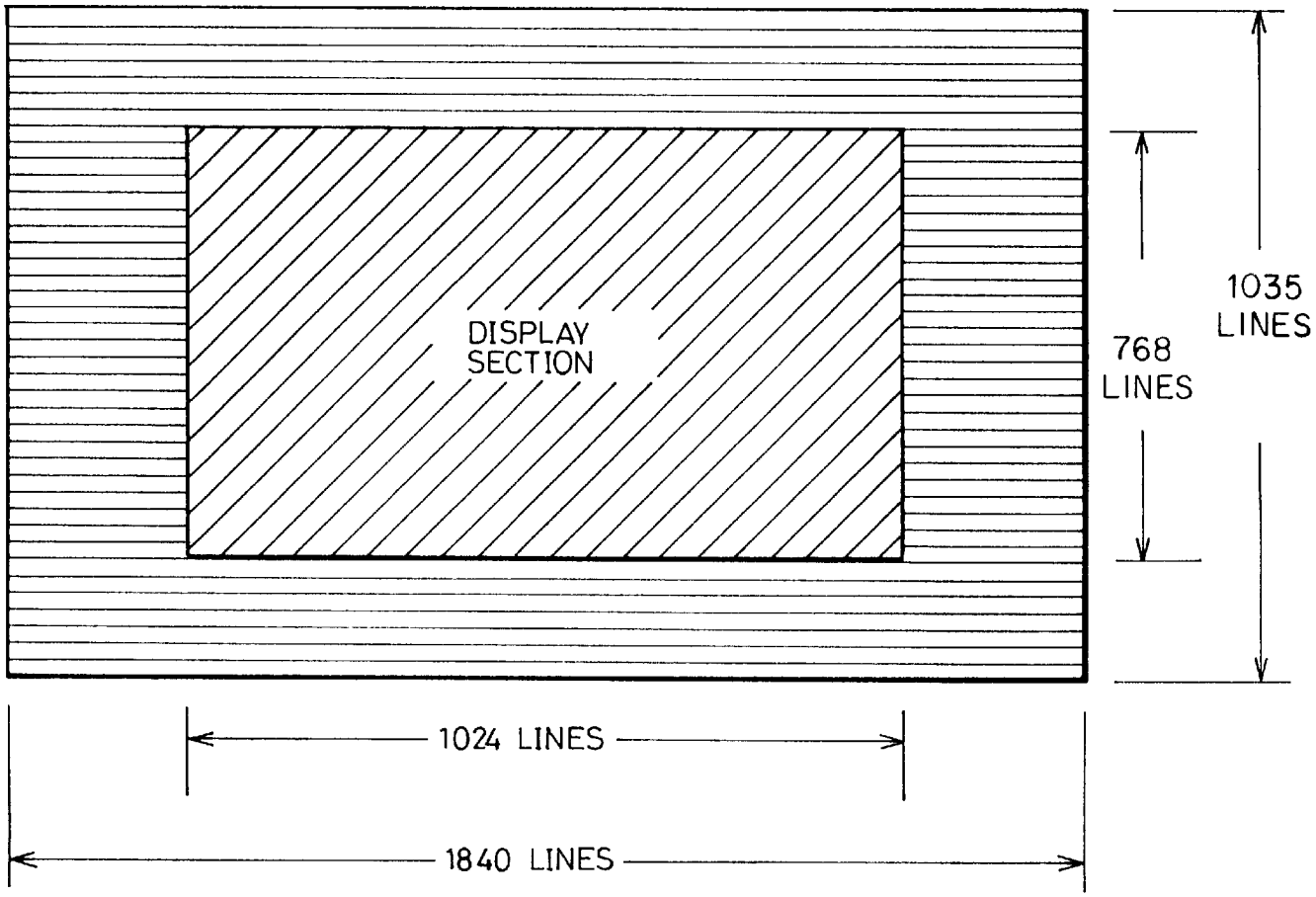
FIG. 45 is an explanatory view of an image satisfying the XGA standard, displayed in a display device for displaying images satisfying the HDTV standard.
Figure 46:
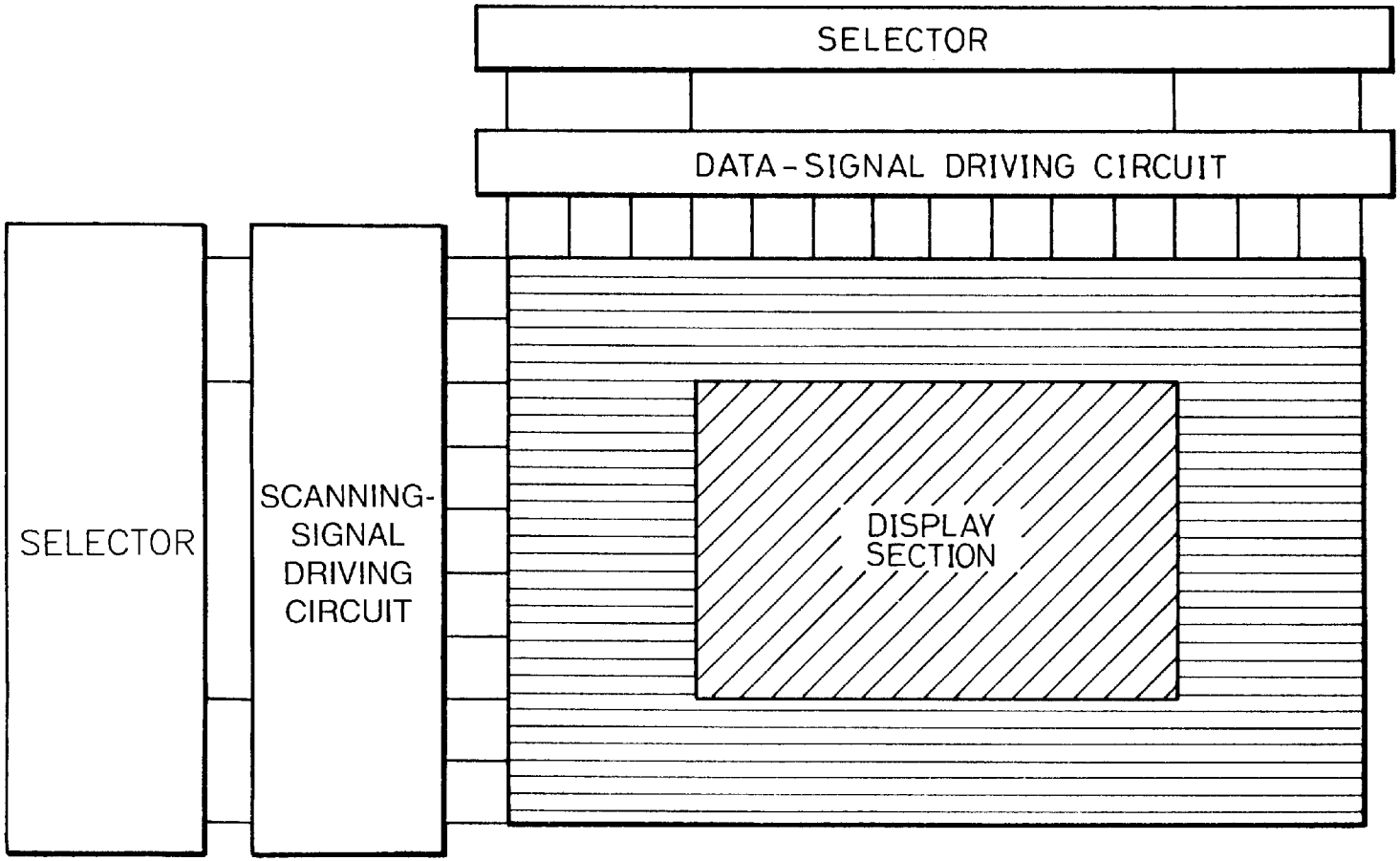
FIG. 46 is a block diagram of an image display device capable of displaying both the image of the HDTV standard and the image of the XGA standard.

When the decoding section 1-4-i enters into the high-impedance state, the output signal line 1-3-i goes into a floating state. Therefore, until the next reset signal or the next pulse signal is input, the OFF voltage is not sometimes maintained due to the wiring capacity and the load capacity of the output signal line 1-3-i. In this case, an effective way of maintaining the OFF voltage is to provide a capacitor 11-1 between the output signal line 1-3-i and a section where a voltage is constant at least in a horizontal scanning period like GND as shown in FIG. 35(*a*), or a latch circuit 12-1 in series with the output signal line 1-3-i as shown in FIG. 35(*b*).

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A scanning circuit for use in an image display device comprising a decoder for outputting scanning pulses according to 2m pulse signals, each of the pulse signals being formed by m signals and m inverted signals which are the inverse of the m signals, said decoder including first to lth decoding sections for sequentially outputting the scanning pulses to l lines of output signal lines where l satisfies a condition of $l \leqq 2^m$, wherein each of said decoding sections comprises a first transistor, and second to (m+1)th transistors having a channel including majority carriers of a type different from that of majority carriers of said first transistor, drains and sources of said first to (m+1)th transistors are connected in series, the scanning pulses are output from a junction between said first and second transistors, a reset signal is input to a gate of said first transistor, the reset signal switching on said first transistor when the pulse signal is switched from a high level to low level or from low level to high level, and the pulse signals are input to gates of said second to (m+1)th transistors.

2. The scanning circuit according to claim 1, wherein the scanning pulses from the junctions between said first and second transistors in said second to lth decoding sections and said first decoding section are input as the reset signals to the gates of said first transistors in said first to lth decoding sections, respectively.

3. The scanning circuit according to claim 1, further comprising capacitors, connected to said output signal lines, for keeping levels of said output signal lines.

4. The scanning circuit according to claim 1, further comprising first and second inverting circuits for keeping levels of said output signal lines, wherein said first inverting circuit is inserted in series to said output signal lines, and an input and on output of said second inverting circuit are connected to an output and an input of said first inverting circuit, respectively.

5. The scanning circuit according to claim 2, further comprising capacitors, connected to said output signal lines, for keeping levels of said output signal lines.

6. The scanning circuit according to claim 2, further comprising first and second inverting circuits for keeping levels of said output signal lines, wherein said first inverting circuit is inserted in series to said output signal lines, and an input and on output of said second inverting circuit are connected to an output and an input of said first inverting circuit, respectively.

7. A scanning circuit for use in an image display device comprising a decoder for outputting scanning pulses according to 2m pulse signals, each of the pulse signals being formed by m signals and m inverted signals which are the inverse of the m signals, said decoder including first to lth decoding sections for sequentially outputting the scanning pulses to l lines of output signal lines where l satisfies a condition of $l \leqq 2^m$, wherein each of said decoding sections comprises a first transistor, and second to (m+2)th transistors having a channel including majority carriers of a type different from that of majority carriers of said first transistor, drains and sources of said first to (m+2)th transistors are connected in series, the scanning pulses are output from a junction between said first and second transistors, reset signals are input to a gates of said first and second transistors, the reset signals switching on said first transistor and switching off said second transistor when levels of the pulse signals are switched from high level to low level or from low level to high level, and the pulse signals are input to gates of said third to (m+2)th transistors.

8. The scanning circuit according to claim 7, wherein the scanning pulses from the conjunctions between said first and second transistors in said second to lth and first decoding sections are input as the reset signals to the gates of said first transistors in said first to lth decoding sections, respectively.

9. The scanning circuit according to claim 7, further comprising capacitors, connected to said output signal lines, for keeping levels of said output signal lines.

10. The scanning circuit according to claim 7, further comprising first and second inverting circuits for keeping levels of said output signal lines, wherein said first inverting circuit is inserted in series to said output signal lines, and an input and an out put of said second inverting circuit are connected to an output and an input of said first inverting circuit, respectively.

11. The scanning circuit according to claim 8, further comprising capacitors, connected to said output signal lines, for keeping levels of said output signal lines.

12. The scanning circuit according to claim 8, further comprising first and second inverting circuits for keeping levels of said output signal lines, wherein said first inverting circuit is inserted in series to said output signal lines, and an input and an output of said second inverting circuit are connected to an output and an input of said first inverting circuit, respectively.

13. The scanning circuit according to claim 1, wherein pulse signals which are all changed to high level or low level for a predetermined period immediately before the levels of the pulse signals are changed are input to said decoder.

14. The scanning circuit according to claim 3, wherein pulse signals which are all changed to high level or low level for a predetermined period immediately before the levels of the pulse signals are changed are input to said decoder.

15. The scanning circuit according to claim 4, wherein pulse signals which are all changed to high level or low level for a predetermined period immediately before the levels of the pulse signals are changed are input to said decoder.

16. The scanning circuit according to claim 7, wherein pulse signals which are all changed to high level or low level for a predetermined period immediately before the levels of the pulse signals are changed are input to said decoder.

17. The scanning circuit according to claim 9, wherein pulse signals which are all changed to high level or low level for a predetermined period immediately before the levels of the pulse signals are changed are input to said decoder.

18. The scanning circuit according to claim 10, wherein pulse signals which are all changed to high level or low level for a predetermined period immediately before the levels of the pulse signals are changed are input to said decoder.

19. The scanning circuit according to claim 7, wherein the reset signals are input to said decoder for a predetermined period immediately before the levels of the pulse signals are changed.

20. The scanning circuit according to claim 1, wherein said output signal lines have a capacitance capable of maintaining a non-selective level until the next reset signal is input.

21. The scanning circuit according to claim 2, wherein said output signal lines have a capacitance capable of maintaining a non-selective level until the next reset signal is input.

22. The scanning circuit according to claim 7, wherein said output signal lines have a capacitance capable of maintaining a non-selective level until the next reset signal is input.

23. The scanning circuit according to claim 1, wherein the transistors to which the inverted signals are input as the pulse signals are changed to have a channel including majority carriers of a type equal to that of said first transistor, and non-inverted signals are input as the pulse signals instead of the inverted signal to gates of said changed transistors.

24. The scanning circuit according to claim 7, wherein the transistors to which the inverted signals are input as the pulse signals are changed to have a channel including majority carriers of a type equal to that of said first transistor, and non-inverted signals are input as the pulse signals instead of the inverted signal to gates of said changed transistors.

25. An image display device comprising:

a plurality of data signal lines arranged in columns;

a plurality of scanning signal lines arranged in rows;

pixel arrays formed by pixels arranged in intersections of said data signal lines and said scanning signal lines;

a data-signal-line driving circuit for supplying video signals to said data signal lines; and a scanning-signal-line driving circuit for supplying scanning pulses to said scanning signal lines, said scanning-signal-line driving circuit including a decoder for outputting scanning pulses according to 2m pulse signals, each of the pulse signals being formed by m signals and m inverted signals which are the inverse of the m signals, said decoder comprising first to lth decoding sections for sequentially outputting the scanning pulses to l lines of output signal lines where l satisfies a condition of $l \leqq 2^m$, wherein each of said decoding sections comprises a first transistor, and second to (m+1)th transistors having a channel including majority carriers of a type different from that of majority carriers of said first transistor, drains and sources of said first to (m+1)th transistors are connected in series, the scanning pulses are output from a junction between said first and second transistors, a reset signal is input to a gate of said first transistor, the reset signal switching on said first transistor when levels of the pulse signal are switched from high level to low level or from low level to high level, and the pulse signals are input to gates of said second to (m+1)th transistors.

26. An image display device comprising:

a plurality of data signal lines arranged in columns;

a plurality of scanning signal lines arranged in rows;

pixel arrays formed by pixels arranged in intersections of said data signal lines and said scanning signal lines;

a data-signal-line driving circuit for supplying video signals to said data signal lines; and a scanning-signal-line driving circuit for supplying scanning pulses to said scanning signal lines, said scanning-signal-line driving circuit including a decoder for outputting scanning pulses according to 2m pulse signals, each of the pulse signals being formed by m signals and m inverted signals which are the inverse of the m signals, said decoder comprising first to lth decoding sections for sequentially outputting the scanning pulses to l lines of output signal lines where l satisfies a condition of $l \leqq 2^m$, wherein each of said decoding sections comprises a first transistor, and second to (m+2)th transistors having a channel including majority carriers of a type different from that of majority carriers of said first transistor, drains and sources of said first to (m+1)th transistors are connected in series, the scanning pulses are output from a junction between said first and second transistors, reset signals are input to gates of said first and second transistors, the reset signals switching on said first transistor and switching off said second transistor when levels of the pulse signals are switched from high level to low level or from low level to high level, and the pulse signals are input to gates of third to (m+2)th transistors.

* * * * *